US008524435B2

(12) United States Patent
Hobo et al.

(10) Patent No.: US 8,524,435 B2
(45) **Date of Patent: *Sep. 3, 2013**

(54) LIQUID DEVELOPER AND WET-TYPE IMAGE FORMING APPARATUS

(75) Inventors: Jumpei Hobo, Osaka (JP); Katsuki Osanishi, Osaka (JP)

(73) Assignee: Kyocera Mita Corporation (JP)

( * ) Notice: Subject to any disclaimer, the term of this patent is extended or adjusted under 35 U.S.C. 154(b) by 69 days.

This patent is subject to a terminal disclaimer.

(21) Appl. No.: 13/046,992

(22) Filed: Mar. 14, 2011

(65) Prior Publication Data

US 2011/0222911 A1 Sep. 15, 2011

(30) Foreign Application Priority Data

| | | |
|---|---|---|
| Mar. 15, 2010 | (JP) | 2010-058012 |
| Mar. 25, 2010 | (JP) | 2010-069526 |
| Apr. 20, 2010 | (JP) | 2010-096595 |
| Apr. 22, 2010 | (JP) | 2010-098896 |
| May 28, 2010 | (JP) | 2010-122304 |

(51) Int. Cl.
*G03G 9/00* (2006.01)

(52) U.S. Cl.
USPC ..... 430/115; 430/112; 430/114; 430/116

(58) Field of Classification Search
USPC ..... 430/112, 114, 115, 116
See application file for complete search history.

(56) References Cited

U.S. PATENT DOCUMENTS

| | | | | |
|---|---|---|---|---|
| 3,293,183 | A | 12/1966 | Matkan | |
| 3,703,400 | A | 11/1972 | Tamai et al. | |
| 4,473,629 | A | 9/1984 | Herrmann et al. | |
| 4,614,699 | A | 9/1986 | Kitatani et al. | |
| 4,965,163 | A * | 10/1990 | Suzuki et al. | 430/114 |
| 5,324,611 | A * | 6/1994 | Fuller et al. | 430/108.2 |
| 5,759,733 | A * | 6/1998 | Tsubuko et al. | 430/115 |
| 2003/0099894 | A1 | 5/2003 | Tsubuko et al. | |
| 2003/0152858 | A1 | 8/2003 | Osan et al. | |
| 2007/0248381 | A1 | 10/2007 | Akioka et al. | |
| 2011/0294065 | A1 * | 12/2011 | Hobo et al. | 430/115 |

FOREIGN PATENT DOCUMENTS

| | | |
|---|---|---|
| JP | 58002851 | 1/1983 |
| JP | 635237 | 2/1994 |
| JP | 8-262809 | 10/1996 |
| JP | 9160389 | 6/1997 |
| JP | 200019787 | 1/2000 |
| JP | 2002214484 | 7/2002 |
| JP | 2002214848 | 7/2002 |
| JP | 2003-241440 | 8/2003 |
| JP | 2008-242039 | 10/2008 |
| JP | 2008242039 | 10/2008 |

* cited by examiner

*Primary Examiner* — Mark F Huff
*Assistant Examiner* — Stewart Fraser
(74) *Attorney, Agent, or Firm* — Gerald E. Hespos; Michael J. Porco; Matthew T. Hespos

(57) ABSTRACT

A liquid developer containing an electrically insulating carrier fluid and colored particles dispersed in the carrier fluid and a wet-type image forming apparatus using this liquid developer are provided, with the colored particles being pigments and this liquid developer containing at least one selected from a group consisting of styrene elastomer, polyvinyl butyral, cyclic olefin copolymer and cellulose ether. Additionally, a liquid developer containing an electrically insulating carrier fluid, colored particles dispersed in the carrier fluid, and an organic macromolecular compound for fixing the colored particles to a recording medium and a wet-type image forming apparatus using this liquid developer are provided, with the organic macromolecular compound being dissolved in the carrier fluid and the colored particles being pigments.

11 Claims, 2 Drawing Sheets

LIQUID DEVELOPER AND WET-TYPE IMAGE FORMING APPARATUS

BACKGROUND OF THE INVENTION

1. Field of the Invention

The present invention relates to the technical field of a wet-type development method, which is one type of electrophotographic system employed in a printer, a copier, a facsimile device, or a multifunctional apparatus incorporated with the functions of the foregoing devices.

2. Description of the Related Art

Generally speaking, a development method that is adopted in an image forming apparatus using the electrophotographic system which develops an electrostatic latent image with charged colored particles can be broadly classified into a dry-type development method and a wet-type development method depending on the form of the developer. Among the above, the wet-type development method uses a liquid developer in which colored particles are dispersed in an electrically insulating carrier fluid. The colored particles charged in the liquid developer move from a developing roller surface to a photoconductor drum surface based on the principle of electrophoresis, and develop an electrostatic latent image on the photoconductor drum surface. The obtained image is transferred from the photoconductor drum to a recording medium. Since the colored particles in the liquid developer will hardly be scattered into the atmosphere, for example, fine colored particles with an average particle diameter of a submicron size can be used, and a high definition image of high resolution and superior gradation can be obtained.

With an image forming apparatus adopting the electrophotographic system, as a method of fixing the image; that is, the colored particles to the recording medium, known are the heat fixing method and the light fixing method. The heat fixing method is a method of fixing toners to the recording medium by melting a binding resin with heat in cases where the colored particles are toners in which pigments are dispersed in the binding resin. The light fixing method is a method of fixing toners to the recording medium by using a binding resin with a photoreactive functional group as the binding resin, and polymerizing such binding resin with light in cases where the colored particles are toners in which pigments are dispersed in the binding resin. Moreover, it is also known that, by using a specific copolymerized resin and a specific pigment, it is possible to obtain a liquid developer in which are dispersed copolymerized resin particles comprising the pigment with a core part that does not dissolve in an electrically insulated dispersion medium and an outer edge portion which dissolves in the dispersion medium, and that, by using the foregoing liquid developer, it is possible to obtain superior dispersion stability and transfer efficiency without causing any gelling, flocculation, precipitation or the like even if the particle concentration is increased.

Nevertheless, with the foregoing conventional method, it is still necessary to perform a heat-fixing that the resin is melted or dissolved with a high temperature in order to fix the liquid developer including the pigment to the recording paper. In other words, with the heat fixing method and the light fixing method of a wet-type image forming apparatus adopting the conventional wet-type development method, considerable thermal energy or light energy is consumed in order to fix the colored particles to the recording medium.

SUMMARY OF THE INVENTION

Thus, an object of this invention is to fix colored particles to a recording medium without consuming considerable thermal energy or light energy, thereby reduce the consumption energy in the wet-type image forming apparatus, and additionally improve the image quality.

Specifically, according to one aspect of the present invention provided is a liquid developer containing an electrically insulating carrier fluid and colored particles dispersed in the carrier fluid, wherein the colored particles are pigments, and the liquid developer contains at least one selected from a group consisting of styrene elastomer, polyvinyl butyral, cyclic olefin copolymer and cellulose ether.

Moreover, according to another aspect of the present invention, provided is a liquid developer containing an electrically insulating carrier fluid, colored particles dispersed in the carrier fluid, and an organic macromolecular compound for fixing the colored particles to a recording medium, wherein the organic macromolecular compound is dissolved in the carrier fluid, and wherein the colored particles are pigments.

Further, according to yet another aspect of the present invention, provided is a wet-type image forming apparatus comprising: a charging device for charging a surface of a photoconductor drum; an exposure device for forming an electrostatic latent image on the surface of the charged photoconductor drum; a liquid developing device for developing an electrostatic latent image on the surface of the photoconductor drum with a liquid developer; and a transfer device for transferring the developed image to a recording medium, wherein the foregoing liquid developer is used as the liquid developer.

According to the liquid developer and the wet-type image forming apparatus of the present invention, pigments as the colored particles can be fixed to a recording medium with non-heating or at low temperature without having to consume considerable thermal energy or light energy, and it is thereby possible to reduce the consumption energy of the wet-type image forming apparatus. Moreover, it is possible to eliminate or simplify the conventional fixing part (fixing device) itself which consumes considerable thermal or light energy, and thereby achieve the simplification and cost reduction of the wet-type image forming apparatus. In addition, since the colored particles may not fall off from the recoding medium and the image is not smeared, it is possible to obtain a high quality image.

DETAILED DESCRIPTION OF THE PREFERRED EMBODIMENTS

In light of the circumstances where considerable thermal or light energy is being consumed for fixing an image to a recording medium in a fixing process of a conventional wet-type image forming method, as a result of intense study to develop a favorable liquid developer from the perspective of energy conservation, the present inventors discovered that by using pigments themselves as the colored particles rather than toners in which pigments are dispersed in the binding resin, and additionally causing the liquid developer to contain styrene elastomer, polyvinyl butyral, cyclic olefin copolymer and/or cellulose ether, the styrene elastomer, polyvinyl butyral, cyclic olefin copolymer and/or cellulose ether remains on a surface of a recording medium and is able to form a coated layer when the carrier fluid is absorbed within the recording medium after the image is transferred to the recording medium, and thereby completed this invention.

First Embodiment

The liquid developer according to this embodiment is a liquid developer containing an electrically insulating carrier fluid and colored particles dispersed in the carrier fluid, wherein the colored particles are pigments, and wherein the liquid developer contains styrene elastomer. Since the styrene elastomer coats the pigments remaining on the surface of the recording medium and forms a coated layer by remaining on the surface of the recording medium when the carrier fluid is absorbed within the recording medium after the image is transferred to the recording medium, the pigments are fixed to the recording medium with the coated layer of the styrene elastomer. It is thereby possible to fix the pigments; that is, the image, to the recording medium without consuming considerable thermal energy or light energy, and reduce the consumption energy in the wet-type image forming apparatus.

<Liquid Developing Device and Wet-Type Image Forming Apparatus>

The liquid developing device and the wet-type image forming apparatus according to this embodiment are foremost explained with reference to the appended drawings. Note that the terms representing directions such as "up", "down", "left" and "right" used in the ensuing explanation are used simply for clarifying the explanation, and are not intended to limit the present invention in any way. Moreover, the term "sheet" used in the ensuing explanation refers to any and all recording mediums on which an image can be formed; for instance, quality plain paper, copying paper, tracing paper, cardboard, OHP sheet and the like.

Figure 1:
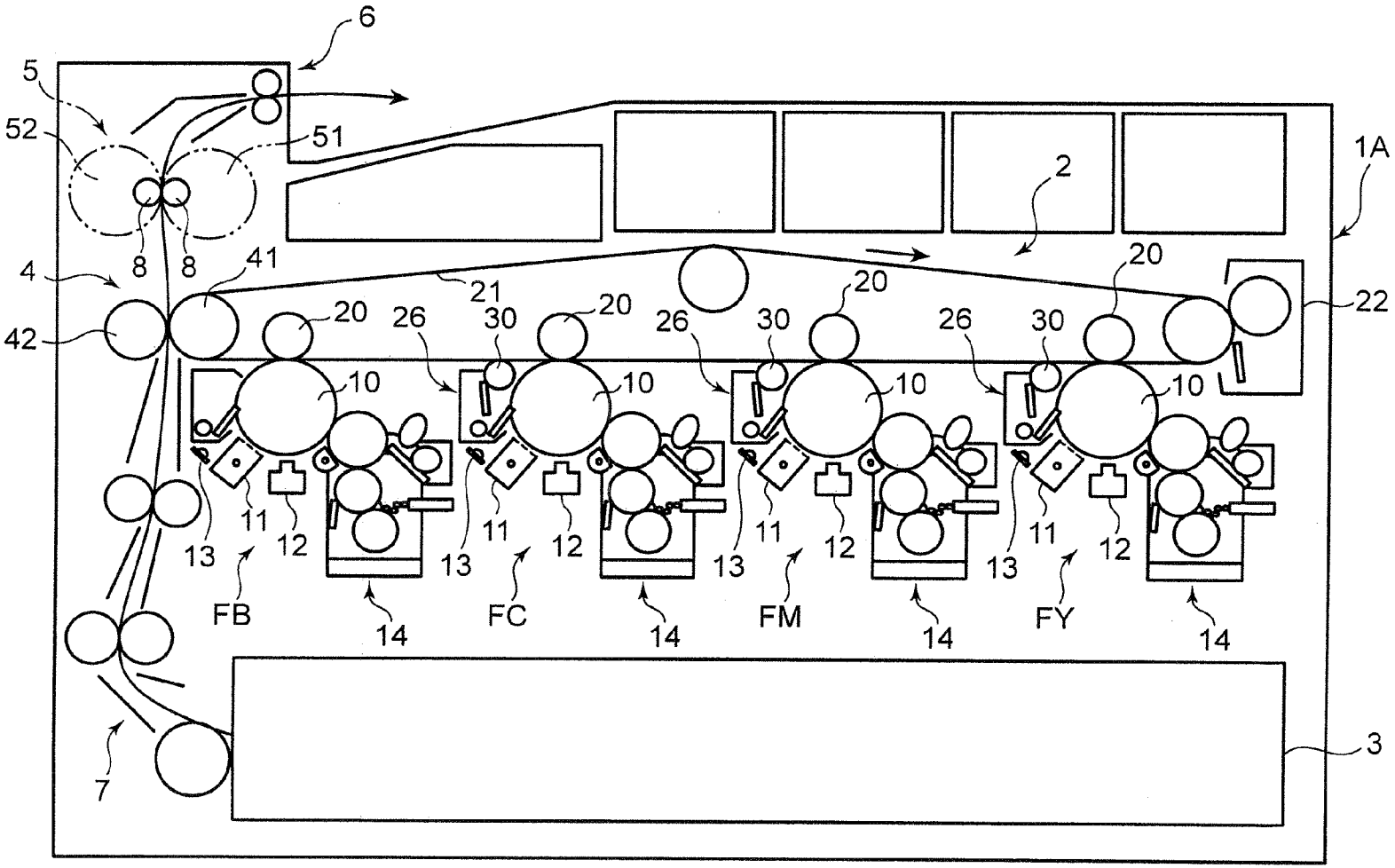
FIG. 1 is a schematic configuration diagram of a wet-type image forming apparatus according to an embodiment of the present invention.
Figure 2:
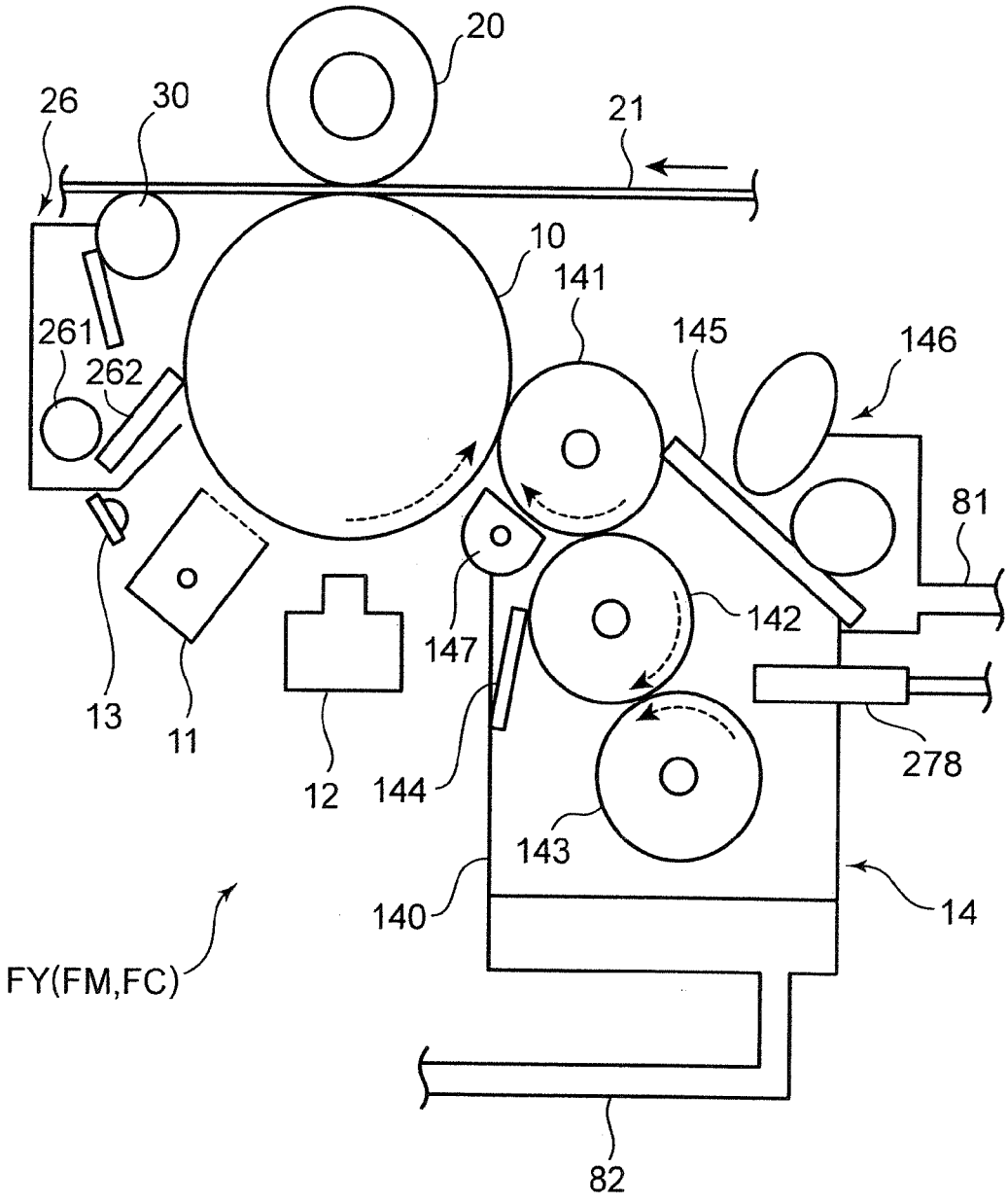
FIG. 2 is a schematic configuration diagram of a liquid developing device and its peripheral part equipped in the wet-type image forming apparatus shown in FIG. 1.

FIG. 1 is a schematic configuration diagram of the wet-type image forming apparatus according to this embodiment, and FIG. 2 is a schematic configuration diagram of a liquid developing device and its peripheral part equipped in the wet-type image forming apparatus shown in FIG. 1. Note that, although the wet-type image forming apparatus according to this embodiment is a color printer, for example, the wet-type image forming apparatus can also be a black-and-white printer, a copier, a facsimile device, a multifunction apparatus comprising the functions of the foregoing devices, or any other wet-type image forming apparatus capable of forming an image on a sheet; that is, on a recording medium.

As shown in FIG. 1, the wet-type image forming apparatus 1A according to this embodiment stores various units and parts for forming an image. The image forming apparatus 1A additionally houses a liquid developer circulation device for the respective colors of yellow (Y), magenta (M), cyan (C), black (Bk) below the portion shown in FIG. 1, but this is not shown in the drawings.

The wet-type image forming apparatus 1A includes a tandem-type image forming part 2 for forming an image based on an image data, a sheet housing part 3 for housing sheets, a secondary transfer part 4 for transferring the image formed by the image forming part 2 onto the sheet, an ejection part 6 for ejecting the sheet to which the image has been completely fixed outside of the apparatus, and a sheet transport part 7 for transporting the sheet from the sheet housing part 3 to the ejection part 6.

Generally speaking, with a wet-type image forming apparatus, under normal circumstances, a fixing part 5 (including a heating roller 51 and a pressure roller 52 placed opposite each other so as to sandwich the sheet passing therethrough) is disposed between the secondary transfer part 4 and the ejection part 6 in order to fix the transferred image to the sheet as shown with the imaginary line in FIG. 1. Nevertheless, the wet-type image forming apparatus 1A according to this embodiment does not include this kind of fixing part, and, in substitute, simply includes sheet transport rollers 8, 8. In other words, the wet-type image forming apparatus 1A according to this embodiment can fix the transferred image to the sheet without requiring the fixing part as a result of using the liquid developer according to this embodiment described later. Specifically, in this embodiment, it is possible to eliminate the conventionally used fixing part 5 which consumes considerable thermal or light energy, and to realize the simplification and cost reduction of the wet-type image forming apparatus 1A.

The image forming part 2 includes an intermediate transfer belt 21, a cleaning part 22 of the intermediate transfer belt 21, and image forming units FY, FM, FC, FB each corresponding to the respective colors of yellow (Y), magenta (M), cyan (C), black (Bk).

The intermediate transfer belt 21 is a wide, conductive endless belt member and is rotatably driven in the clockwise direction as shown with the arrow in FIG. 1. The surface facing the outside in the rotational drive of the intermediate transfer belt 21 is referred to as the "front surface" and the surface facing the inside is referred to as the "rear surface".

The image forming units FY, FM, FC, FB are aligned along the lower moving surface of the intermediate transfer belt 21. Note that the order of arranging the image forming units FY, FM, FC, FB is not limited to the example of FIG. 1, but the arrangement shown in FIG. 1 is one of the preferred arrangements from the perspective of avoiding influence to the completed image caused by color mixture of the respective colors.

Each of the image forming units FY, FM, FC, FB respectively includes a photoconductor drum 10, a charging device 11, an LED exposure device 12, a liquid developing device 14, a primary transfer roller 20, a cleaning device 26, a neutralization device 13, and a carrier fluid removal roller 30. Note that, among the image forming units, although the black image forming unit FB disposed closest to the secondary transfer part 4 is not provided with the carrier fluid removal roller 30, the remaining configuration of the black image forming unit FB is the same as the other image forming units FY, FM, FC.

The surface (circumferential surface) of the columnar photoconductor drum 10 is able to support an image developed with charged (charged to a positive polarity in this embodiment) colored particles. The photoconductor drum 10 shown in FIG. 1 can rotate in the counterclockwise direction.

The charging device 11 uniformly charges the surface of the photoconductor drum 10. The operation of the charging device 11 configures a charging process.

The LED exposure device 12 includes an LED as its light source, and irradiates light onto the surface of the uniformly charged photoconductor drum 10 based on the image data input from an outside device. An electrostatic latent image based on the image data is thereby formed on the surface of the photoconductor drum 10. The operation of the exposure device 12 configures an exposure process.

The liquid developing device 14 retains the liquid developer containing an electrically insulating carrier fluid and colored particles dispersed in the carrier fluid so as to face the electrostatic latent image formed on the surface of the photoconductor drum 10. The electrostatic latent image is thereby developed on the surface of the photoconductor drum 10 with the charged colored particles, and the image is thereby developed. The operation of the liquid developing device 14 configures a development process. Note that the liquid developing device 14 and the wet-type image forming apparatus 1A according to this embodiment use, as the liquid developer, a liquid developer containing styrene elastomer with the pigments as the colored particles, and this will be described in detail later.

As shown in FIG. 2, the liquid developing device 14 includes a developing vessel 140, a developing roller 141, a supply roller (anilox roller) 142, a support roller 143, a supply roller blade 144, a cleaning blade 145, a developer recovery device 146 and a developing roller charging device 147.

The developing vessel 140 is internally supplied with the liquid developer, and stores the liquid developer therein. The liquid developer is supplied, after the concentration of the colored particles in the carrier fluid is controlled in advance, from the supply nozzle 278 into the developing vessel 140. Here, the liquid developer is supplied toward a nip part between the supply roller 142 and the support roller 143, and the excess drops below the support roller 143, and is retained at the bottom of the developing vessel 140. The retained liquid developer is recovered through a pipe 82 and thereafter recycled and reused.

The support roller 143 is disposed at the approximate center of the developing vessel 140, and forms the nip part by coming in contact with the supply roller 142 from below. The supply roller 142 is not disposed right above the support roller 143, but disposed in a manner of becoming apart from the supply nozzle 278. The circumferential surface of the supply roller 142 is provided with a groove for retaining the liquid developer. As shown with the dotted arrow in FIG. 2, the support roller 143 rotates in the counterclockwise direction and the supply roller 142 rotates in the clockwise direction.

The liquid developer supplied from the supply nozzle 278 is temporarily retained at the upstream side of the rotating direction of the support roller 143 of the nip part between the supply roller 142 and the support roller 143, and is carried upward in a state of being retained in the groove of the supply roller 142 with the rotation of both rollers 142, 143. The supply roller blade 144 is press-contacted with the circumferential surface of the supply roller 142, and controls the amount of the liquid developer retained in the groove of the supply roller 142 to be a predetermined amount. The excess liquid developer scraped with the supply roller blade 144 is retained at the bottom of the developing vessel 140.

The developing roller 141 is disposed at the upper opening of the developing vessel 140 in a manner of coming in contact with the supply roller 142. The developing roller 141 rotates in the same direction as the supply roller 142. Consequently, at the nip part where the developing roller 141 and the supply roller 142 come in contact, the surface of the developing roller 141 moves in the opposite direction as the surface of the supply roller 142. The circumferential surface of the developing roller 141 thereby receives the liquid developer retained on the circumferential surface of the supply roller 142. Since the amount of the liquid developer (thickness of the thin layer of the liquid developer) retained in the groove of the supply roller 142 is controlled to be a predetermined value, the amount of the liquid developer (thickness of the thin layer of the liquid developer) retained on the surface of the developing roller 141 is also maintained at a predetermined value.

The developing roller charging device 147 causes the colored particles in the thin layer of the liquid developer supported by the surface of the developing roller 141 to move to the surface side of the developing roller 141 by applying, from the outer surface side of the development roller 141, a bias potential (bias potential of a positive polarity in this embodiment) of the same polarity as the charging polarity of the colored particles (the application being equal to a developing corona charge). Consequently, the colored particles in the thin layer of the liquid developer are gathered and compressed (compaction process) to the side of the developing roller 141 based on the electrical field effect, and a high concentration colored particle layer is formed on the side of the developing roller 141. Subsequently, the thin layer of the liquid developer is supplied to the photoconductor drum 10, and an electrostatic latent image is developed on the photoconductor drum 10. A high-resolution image with improved development efficiency is thereby formed. The developing roller charging device 147 is provided to face the circumferential surface of the developing roller 141 at a point in downstream side from a contact part of the developing roller 141 and the supply roller 142 relative to the rotating direction of the developing roller 141, and in upstream side from a contact part of the developing roller 141 and the photoconductor drum 10 relative to the rotating direction of the developing roller 141. Specifically, the developing roller charging device 147 generates an electric field based on the developing corona charge. The thin layer of the liquid developer on the developing roller 141 thereby becomes a double layer of the colored particle layer on the developing roller 141 surface and a carrier fluid layer on the colored particle layer. In the development region (adjacent region between the developing roller 141 and the photoconductor drum 10 and the peripheral region thereof), the thin layer of the liquid developer on the developing roller 141 comes in contact with the surface of the photoconductor drum 10 in the foregoing double layer state. Here, the colored particles which are gathered and compressed on the side of the developing roller 141 move from the surface of the developing roller 141 to the surface of the photoconductor drum 10 based on the principle of electrophoresis, and develop the electrostatic latent image on the surface of the photoconductor drum 10 as an image. Since the colored particles in the thin layer of the liquid developer on the developing roller 141 is compressed on the surface of the developing roller 141 (compaction process) before the development, with the developing corona charge of the developing roller charging device 147, the colored particles may not come in contact with the non-image region on the photoconductor drum 10, and it is thereby possible to inhibit fogging around the image formed on the photoconductor drum 10. Moreover, since an electric charge is injected into the colored particles in the thin layer of the liquid developer on the developing roller 141 due to the formation of an electric field by the developing corona charge, the colored particles are developed, with favorable reagency, on the electrostatic latent image on the photoconductor drum 10 based on the development field, and the colored particles are electrostatically attached on the surface of the photoconductor drum 10 in a firm manner.

The developing roller 141 is in contact with the photoconductor drum 10, and an image based on image data is formed on the surface of the photoconductor drum 10 due to the potential difference between the potential of the electrostatic latent image on the surface of the photoconductor drum 10 and the development field that is applied to the developing roller 141.

The cleaning blade 145 is disposed to come in contact with the developing roller 141 at a point in downstream side from a contact part of the developing roller 141 and the photoconductor drum 10 relative to the rotating direction of the developing roller 141, and removes the liquid developer on the surface of the developing roller 141 that completed its development operation to the photoconductor drum 10.

The developer recovery device 146 recovers the liquid developer that was removed by the cleaning blade 145, and sends the liquid developer to the pipe 81 of the liquid developer circulation device. The liquid developer flows downward along the surface of the cleaning blade 145, but since the viscosity of the liquid developer is high, one or more delivery rollers for assisting the delivery of the liquid developer is provided to the developer recovery device 146.

The primary transfer roller 20 is disposed opposite to the photoconductor drum 10 in a state of coming in contact with the rear surface of the intermediate transfer belt 21. The primary transfer roller 20 is subject to the application of a voltage of a reverse polarity (negative in this embodiment) as the colored particles in the image from a power source (not shown). The primary transfer roller 20 applies a voltage of a reverse polarity as the colored particles to the intermediate transfer belt 21 at a position of coming in contact with the intermediate transfer belt 21. Since the intermediate transfer belt 21 possesses conductivity, the colored particles are gravitated from the photoconductor drum 10 to the surface side of the intermediate transfer belt 21 and the periphery thereof based on the applied voltage. In other words, the image developed on the surface of the photoconductor drum 10 is transferred to the intermediate transfer belt 21. The intermediate transfer belt 21 functions as an image carrier for supporting the image and carrying it to the sheet.

The cleaning device 26 is a device for cleaning the residual liquid developer that was not transferred from the photoconductor drum 10 to the intermediate transfer belt 21. The cleaning device 26 includes a residual developer transport screw 261, and a cleaning blade 262. The residual developer transport screw 261 disposed in the cleaning device 26 transports the residual developer that was scraped with the cleaning blade 262 and housed in the cleaning device 26 to the outside of the cleaning device 26.

The plate-shaped cleaning blade 262 extends in the rotation axis direction of the photoconductor drum 10 so as to scrape the liquid developer remaining on the surface of the photoconductor drum 10. One end of the cleaning blade 262 is in sliding contact with the surface of the photoconductor drum 10, and scraps the liquid developer remaining on the photoconductor drum 10 with the rotation of the photoconductor drum 10.

The neutralization device 13 includes a light source for neutralization, and neutralizes the surface of the photoconductor drum 10 with light from the light source after the liquid developer is removed with the cleaning blade 262 in order to prepare for the image formation of the subsequent round.

The approximately columnar carrier fluid removal roller 30 can rotate in the same direction as the photoconductor drum 10 around a rotation axis that is parallel with the rotation axis of the photoconductor drum 10. The carrier fluid removal roller 30 is disposed at a point closer to the secondary transfer part 4 than a contact part of the photoconductor drum 10 and the intermediate transfer belt 21, and removes the carrier fluid from the surface of the intermediate transfer belt 21.

The sheet housing part 3 shown in FIG. 1 houses sheets to which an image is to be fixed and formed on the surface thereof. The sheet housing part 3 is disposed at the lower part of the wet-type image forming apparatus 1A. Moreover, the sheet housing part 3 includes a paper feed cassette (not shown) formed so as to house the sheets.

The secondary transfer part 4 transfers the image formed on the intermediate transfer belt 21 onto the sheet. The secondary transfer part 4 includes a support roller 41 for supporting the intermediate transfer belt 21, and a secondary transfer roller 42 disposed opposite to the support roller 41. Note that, in this embodiment, the secondary transfer part 4 and the primary transfer roller 20 configure the transfer device. Moreover, the operation of the secondary transfer part 4 and the operation of the primary transfer roller 20 configure the transfer process.

Transport rollers 8, 8 are provided at the upper part of the secondary transfer part 4 in substitute for the fixing part 5 as described above.

A sheet to which the image was transferred and completely fixed is ejected from the ejection part 6 provided at the upper face of the wet-type image forming apparatus 1A. The sheet transport part 7 includes a plurality of transport roller pairs, and transports the sheet from the sheet housing part 3 to the ejection part 6 via the secondary transfer part 4. The operation of the ejection part 6 which ejects the image-transferred sheet outside of the apparatus configured the ejecting process.

<Wet-Type Image Forming Method>

The wet-type image forming method according to this embodiment is achieved by using the wet-type image forming apparatus 1A and forming an image on a sheet. Specifically, the wet-type image forming method according to this embodiment includes a charging process of charging the surface of the photoconductor drum 10, an exposure process of forming an electrostatic latent image on the surface of the charged photoconductor drum 10, a development process of forming an image by developing the electrostatic latent image on the surface of the photoconductor drum 10 with a liquid developer containing an electrically insulating carrier fluid and colored particles dispersed in the carrier fluid in which the colored particles are pigments and the liquid developer contains styrene elastomer, a transfer process of transferring the developed image onto a sheet, and an ejecting process of ejecting the image-transferred sheet from the ejection part 6. The wet-type image forming method according to this embodiment is a favorable wet-type image forming method from the perspective of energy conservation capable of fixing the transferred image to the sheet, without having to consume considerable thermal or light energy upon performing the fixing process of fixing the transferred image to the sheet, by using the liquid developer explained below.

<Liquid Developer>

The liquid developer according to this embodiment contains, as its basic configuration, an electrically insulating carrier fluid and colored particles dispersed in the carrier fluid. The colored particles are pigments, and the liquid developer contains styrene elastomer. The content of the styrene elastomer is preferably 0.1 to 10 mass percent.

[Carrier Fluid]

Generally speaking, an electrically insulating carrier fluid functions as a liquid carrier, and is used for increasing the electrical insulation of the obtained liquid developer. As the electrically insulating carrier fluid, an organic solvent possessing electrical insulation and, for instance, having a volume resistance of $10^{10}$ Ω·cm or more (in other words, electrical conductivity of 100 pS/cm or less) at 25° C. is preferably used. As this kind of electrically insulating organic solvent, there is aliphatic hydrocarbon that is a liquid at normal temperature, and, for example, liquid n-paraffinic hydrocarbon, liquid iso-paraffinic hydrocarbon or the mixture thereof, liquid halogenated aliphatic hydrocarbon and the like are preferably used. Specifically, n-hexane, n-heptane, n-octane, nonane, decane, dodecane, cyclohexane, perchloroethylene, trichloroethane and the like may be used. Moreover, aliphatic hydrocarbon with a branched-chain is particularly favorable. Commercially available aliphatic hydrocarbon with a branched-chain may be used, and, for example, "Isopar G," "Isopar H," "Isopar K," "Isopar L," "Isopar M," "Isopar V" manufactured by Exxon Mobile can be preferably used. Moreover, liquid paraffin "Moresco White P-40," "Moresco White P-70," "Moresco White P-200" manufactured by Moresco (the former Matsumura Oil Research Corporation) can also be preferably used. Moreover, liquid paraffin "Cosmo White P-60," "Cosmo White P-70," "Cosmo White P-120" manufactured by Cosmo Oil, Ltd. can also be preferably used.

[Colored Particles]

In this embodiment, as the colored particles, pigments themselves are used rather than toners in which pigments are dispersed in a binding resin. As this kind of pigment, for example, conventionally known organic pigments and inorganic pigments may be used without particular limitation.

For example, as a black pigment, azine-based pigments such as carbon black, oil furnace black, channel black, lamp black, acetylene black, and aniline black; metal salt azo pigments, metal oxides, compound metal oxides and the like may be used. As a yellow pigment, cadmium yellow, mineral fast yellow, nickel titanium yellow, naples yellow, naphthol yellow S, hansa yellow G, hansa yellow 10G, benzidine yellow GR, quinoline yellow lake, permanent yellow NCG, tartrazine lake and the like may be used. As an orange pigment, molybdenum orange, permanent orange GTR, pyrazolone orange, vulcan orange, indanthrene brilliant orange RK, benzidine orange G, indanthrene brilliant orange GK and the like may be used. As a red pigment, colcothar, cadmium red, permanent red 4R, lithol red, pyrazolone red, watching red calcium salt, lake red D, brilliant carmine 6B, eosin lake, rhodamine lake B, alizarin lake, brilliant carmine 3B and the like may be used. As a purple pigment, fast violet B, methyl violet lake and the like may be used. As a blue pigment, C.I. Pigment Blue 15:3, cobalt blue, alkali blue, victoria blue lake, phthalocyanine blue, metal-free phthalocyanine blue, phthalocyanine blue partial chlorination product, fast sky blue, indanthrene blue BC and the like may be used. As a green pigment, chromium green, chromium oxide, pigment green B, malachite green lake and the like may be used.

The content of the pigment in the liquid developer is preferably 1 to 30 mass percent, more preferably 3 mass percent or more and/or 20 mass percent or less, still more preferably 5 mass percent or more and/or 10 mass percent or less.

The average particle diameter of the pigment in the liquid developer; that is, the median diameter ($D_{50}$) of the volumetric basis is preferably 0.1 to 3.0 μm, more preferably 0.2 μm or more and/or 2.0 μm or less, still more preferably 0.4 μm or more and/or 1.0 μm or less. When the average particle diameter of the pigment is less than 0.1 μm, a development performance may be insufficient and an image density may decrease, and more fogging may occur. When the average particle diameter of the pigment exceeds 3.0 μm, a fixability may deteriorate. Here, the median diameter ($D_{50}$) of the volumetric basis refers to the particle diameter of the point where the cumulative curve becomes 50% upon seeking such cumulative curve with the overall volume of the particles of one group generally required in the particle size distribution as 100%.

[Dispersion Stabilizer]

The liquid developer according to this embodiment may contain a dispersion stabilizer for promoting and stabilizing a dispersion of the particles in the liquid developer. As the dispersion stabilizer that can be used in this embodiment, for example, "BYK-116" manufactured by BYK-Chemie may be preferably used. In addition, "Solsperse 9000," "Solsperse 11200," "Solsperse 13940," "Solsperse 16000," "Solsperse 17000," "Solsperse 18000" manufactured by Lubrizol, and "Antaron (registered trademark) V-216," "Antaron (registered trademark) V-220" manufactured by ISP may also be preferably used.

The content of the dispersion stabilizer in the liquid developer is around 1 to 10 mass percent, and preferably around 2 to 6 mass percent.

[Styrene Elastomer]

The liquid developer according to this embodiment contains styrene elastomer. As the styrene elastomer that can be used in this embodiment, conventionally known styrene elastomer may be used without particular limitation. As a specific example thereof, for instance, a block copolymer made of an aromatic vinyl compound, and an olefin compound or a conjugated diene compound may be used. As the foregoing block copolymer, for example, a block copolymer or the like having a structure represented by Formula 1 when a polymer block made of an aromatic vinyl compound is A and a polymer block made of an olefin compound or a conjugated diene compound is B may be used.

$$[A\text{-}B]_x\text{-}A \qquad \text{(Formula 1)}$$

(In the formula, x represents an integer in which the number average molecular weight is 1,000 to 100,000.)

As the aromatic vinyl compound configuring the block copolymer, for example, styrene, α-methylstyrene, o-methylstyrene, m-methylstyrene, p-methylstyrene, 2,3-dimethylstyrene, 2,4-dimethylstyrene, monochlorostyrene, dichlorostyrene, p-bromostyrene, 2,4,5-tribromostyrene, 2,4,6-tribromostyrene, o-tert-butylstyrene, m-tert-butylstyrene, p-tert-butylstyrene, ethylstyrene, vinylnaphthalene, vinylanthracene and the like may be used.

The polymer block A may be configured from one type among the foregoing aromatic vinyl compounds, or be configured from two or more types. Among the above, a polymer block A configured from styrene and/or α-methylstyrene offers physical properties that are favorable for the liquid developer according to this embodiment.

As the olefin compound configuring the block copolymer, for example, ethylene, propylene, 1-butene, 2-butene, isobutene, 1-pentene, 2-pentene, cyclopentene, 1-hexene, 2-hexene, cyclohexene, 1-heptene, 2-heptene, cycloheptene, 1-octene, 2-octene, cyclooctene, vinylcyclopentene, vinylcyclohexene, vinylcycloheptene, vinylcyclooctene and the like may be used.

As the conjugated diene compound configuring the block copolymer, for example, butadiene, isoprene, chloroprene, 2,3-dimethyl-1,3-butadiene, 1,3-pentadiene, 1,3-hexadiene and the like may be used.

The polymer block B may be configured from one type of either the olefin compound or the conjugated diene compound, or be configured from two or more types. Among the above, a polymer block B configured from butadiene and/or isoprene offers physical properties that are favorable for the liquid developer according to this embodiment.

As specific favorable examples of the block copolymer, for example, polystyrene-polybutadiene-polystyrene triblock copolymer or its hydrogen additive, polystyrene-polyisoprene-polystyrene triblock copolymer or its hydrogen additive, polystyrene-poly (isoprene/butadiene)-polystyrene triblock copolymer or its hydrogen additive, poly (α-methylstyrene)-polybutadiene-poly α-methylstyrene) triblock copolymer or its hydrogen additive, poly (α-methylstyrene)-polyisoprene-poly (α-methylstyrene) triblock copolymer or its hydrogen additive, poly (α-methylstyrene)-poly (isoprene/butadiene)-poly (α-methylstyrene) triblock copolymer or its hydrogen additive, polystyrene-polyisobutene-polystyrene triblock copolymer, poly (α-methylstyrene)-polyisobutene-poly α-methylstyrene) triblock copolymer, and the like may be used.

Moreover, as the styrene elastomer that can be used in this embodiment, the styrene-butadiene elastomer (SBS) in which the polymer block A and the polymer block B have a structure represented by Formula 2 can be preferably used.

(Formula 2)

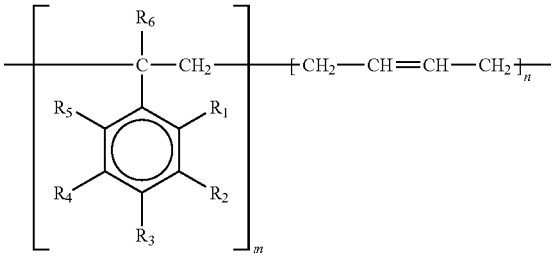

POLYMER BLOCK A POLYMER BLOCK B (In the formula, $R_1$, $R_2$, $R_4$, $R_5$, $R_6$ represent hydrogen atoms or a methyl group; $R_3$ represents hydrogen atoms, a saturated alkyl group with a carbon number of 1 to 20, a methoxy group, an ethoxy group, phenyl group or halogen atoms; and m, n represent an integer in which the content of the polymer block A is 5 to 75 mass percent.)

The styrene-butadiene elastomer can be obtained by copolymerizing styrene monomer, and butadiene as the conjugated diene compound. As a preferred styrene monomer, styrene, α-methylstyrene, o-methylstyrene, m-methylstyrene, p-methylstyrene, p-ethylstyrene, 2,4-dimethylstyrene, p-n-butylstyrene, p-dodecylstyrene, p-methoxystyrene, p-phenylstyrene, p-chlorostyrene and the like may be used.

In the styrene-butadiene elastomer, the number average molecular weight Mn in the molecular weight distribution based on GPC (gel permeation chromatography) is preferably within the range of 1,000 to 100,000 (refer to Formula 1), and more preferably within the range of 2,000 to 50,000. Further, the weight-average molecular weight Mw is preferably within the range of 5,000 to 1,000,000, and more preferably within the range of 10,000 to 500,000. In the foregoing case, preferably, at least one peak exists where the weight-average molecular weight Mw is within the range of 2,000 to 200,000, and preferably within the range of 3,000 to 150,000.

The value of ratio of (weight-average molecular weight Mw/number average molecular weight Mn) of the styrene-butadiene elastomer is preferably 3.0 or less, and more preferably 2.0 or less.

The styrene content (content of polymer block A) in the styrene-butadiene elastomer is preferably within the range of 5 to 75 mass percent (refer to Formula 2), and more preferably within the range of 10 to 65 mass percent. When the styrene content is less than 5 mass percent, the glass-transition temperature of the coated layer of the styrene elastomer may become too low, and the firm formation properties of the styrene elastomer coated layer tend to deteriorate. When the styrene content exceeds 75 mass percent, the softening point of the coated layer of the styrene elastomer may become too high, and the fixability of the pigments; that is, the image, with the styrene elastomer coated layer tends to deteriorate.

An example of a specific method of blending the styrene elastomer with the liquid developer in this embodiment is now explained. For example, when it is difficult to dissolve the styrene elastomer to be used in the carrier fluid to be used, preferably, such styrene elastomer is dissolved in advance in an another carrier fluid or some kind of different solvent capable of dissolving the styrene elastomer, and the obtained solution (in the first embodiment, this is referred to as a "resin solution" for the sake of convenience) is mixed with the carrier fluid to be used.

As the solvent for dissolving the styrene elastomer, a solvent possessing electrical insulation and, for instance, having a volume resistance of $10^{10}$ Ω·cm or more (in other words, electrical conductivity of 100 pS/cm or less) at 25° C. is preferably used. Needless to say, even if the solvent does not possess high electrical resistance, a liquid developer with high electrical resistance can be obtained by mixing such solvent with a carrier fluid with high electrical insulation.

As the solvent for dissolving the styrene elastomer that can be used in this embodiment, for example, aliphatic hydrocarbon, fatty acid ester, ketones, aromatic hydrocarbon, vegetable oil and the like can be used. More specifically, hydrocarbons such as mineral spirit, pentane, hexane, heptane, octane, styrene, benzene, toluene, xylene, and ethylbenzene; chlorinated hydrocarbons such as 2,2-dichloropropane, 1,2-dichloropropane, chloroform, trichloroethylene, tetrachloroethylene, chlorobenzene, methylenechloride, and ethylenedichloride; ketones such as di-isobutyl ketone, di-isopropyl ketone, methylisobutyl ketone, methylamyl ketone, methylpropyl ketone, diethyl ketone, methylethyl ketone, cyclohexanone, acetone, and cyclopentanone; esters such as isobutyln-butyrate, isopropyl-isobutyrate, methylamyl acetate, butylbutyrate, isopropyl acetate, amyl acetate, butyl acetate, cellosolve acetate, propyl acetate, ethyl acetate, and methyl acetate; ethers such as diethylether, dimethylether, dichloroethylether, dioxane, and tetrahydrofuran; and alcohols such as methanol, ethanol, n-propanol, isopropanol, n-butanol, n-pentanol, n-hexanol, cyclohexanol, diethyleneglycol, and glycerol may be used. These solvents may be used independently or as a mixture.

In the liquid developer according to this embodiment, the styrene elastomer exists in a state of being dissolved in the carrier fluid. Consequently, the mechanism of fixing the image to the sheet is basically as follows. Specifically, the styrene elastomer in the liquid developer stored in the developing vessel 140 of the liquid developing device 14 exists in a state of being dissolved in the carrier fluid. This state is the same on the developing roller 141, on the photoconductor drum 10, and on the intermediate transfer belt 21. Needless to say, although the ratio of the carrier fluid in the liquid developer will gradually decrease, the styrene elastomer in the liquid developer is still in the state of being dissolved in the carrier fluid. Subsequently, when the image is transferred from the intermediate transfer belt 21 to the sheet by the secondary transfer part 4, the styrene elastomer and the colored particles (pigments) in the carrier fluid remain on the surface of the sheet, and the carrier fluid is absorbed within the sheet. Pursuant thereto, the concentration of the styrene elastomer in the carrier fluid on the surface of the sheet will increase, and exceeds the saturated solubility. The styrene elastomer that exceeds the saturated solubility coats the pigments remaining on the surface of the sheet and forms a coated layer by remaining on the surface of the sheet. Since the pigments are fixed to the sheet with the coated layer of the styrene elastomer, it is possible to fix the pigments; that is, the image that has been transferred to the sheet, to the sheet without consuming considerable thermal energy or light energy, and reduce the consumption energy in the wet-type image forming apparatus. This is extremely effective from the perspective of environmental protection. Moreover, since the wet-type image forming apparatus 1A according to this embodiment no longer needs the conventional fixing part 5 which uses thermal or light energy, it is possible to seek the simplification and cost reduction of the wet-type image forming apparatus 1A.

Note that a state where the styrene elastomer is dissolved in the carrier fluid also includes a gelled state. Depending on the type and molecular weight of the styrene elastomer, the styrene elastomers could mutually entwine in the carrier fluid and become a gelled state with relatively low fluidity. For example, when the concentration of the styrene elastomer is high or when the affinity of the styrene elastomer and the solvent is low, or when the temperature is low, the styrene elastomer often becomes a gelled state. Meanwhile, when the styrene elastomers hardly become mutually entwined in the carrier fluid and the fluidity is relatively high, the styrene elastomer may be in a liquid state.

A commercially available styrene elastomer can be used in this embodiment. For example, as the styrene-conjugated diene block copolymer, "Septon" and "Hybrar" manufactured by Kuraray, "Kraton" manufactured by Shell, "Asaprene (registered trademark)" and "Tufprene (registered trademark)" manufactured by Asahi Kasei Chemicals Corporation, and "Dynaron" manufactured by JSR can be used; as the styrene-ethylene copolymer, "Index" manufactured by The Dow Chemical Company can be used; and as the composition, "ARON AR" manufactured by ARONKASEI Co., Ltd. and "Rabalon" manufactured by Mitsubishi Chemical Corporation can be used. These may be used independently or as a combination of two or more types depending on the circumstances.

The content of the styrene elastomer in the liquid developer is preferably 0.1 to 10 mass percent, more preferably 0.5 mass percent or more and/or 8 mass percent or less, still more preferably 1 mass percent or more and/or 6 mass percent or less. When the content of the styrene elastomer is less than 0.1 mass percent, the amount of the styrene elastomer coated layer remaining on the surface of the sheet may become too small, and the film formation properties and consequently the fixability may become considerably insufficient. When the content of the styrene elastomer exceeds 10 mass percent, the amount of the styrene elastomer coated layer remaining on the surface of the sheet may become too great, and the drying property of the coated layer may deteriorate excessively, the viscosity (tack properties) of the coated layer may increase excessively, the rubber elasticity of the coated layer may increase excessively, and the scratch resistance of the image may deteriorate excessively.

[Manufacturing Method]

The method of manufacturing the liquid developer according to this embodiment includes a resin solution preparation process, a pigment dispersing element preparation process, and a mixing process of the resin solution and the pigment dispersing element.

The resin solution preparation process is a process of preparing a resin solution by dissolving the styrene elastomer in a highly soluble carrier fluid or solvent in advance. In this process, the content of the styrene elastomer in the resin solution is decided in accordance with the content of the styrene elastomer in the liquid developer to be consequently manufactured, and the mixture ratio (mass ratio) of the resin solution and the pigment dispersing element in the mixing process.

The pigment dispersing element preparation process is a process of preparing a pigment dispersing element in which pigments are dispersed in the carrier fluid in a high concentration by sufficiently mixing and dispersing a carrier fluid, a pigment, and, depending on the circumstances, a dispersion stabilizer using a disperser such as a ball mill, sand grinder, dyno-mill, or rocking mill for a period of several hours or more than 10 hours. In this process, the content of the pigment in the pigment dispersing element is decided in accordance with the content of the pigment in the liquid developer to be consequently manufactured, and the mixture ratio (mass ratio) of the resin solution and the pigment dispersing element in the mixing process.

Based on the wet dispersion and wet pulverization in the pigment dispersing element preparation process, the pigment particles are finely pulverized. The dispersion conditions and pulverization conditions such as the time and rotating speed of performing the wet dispersion and wet pulverization are controlled so that the average particle diameter of the pigment; that is, the median diameter ($D_{50}$) of the volumetric basis becomes, as described above, preferably 0.1 to 3.0 μm, more preferably 0.2 to 2.0 μm, and even more preferably 0.4 to 1.0 μm. when the time of performing the wet dispersion and wet pulverization is excessively short, or when the rotating speed is excessively slow, the average particle diameter ($D_{50}$) of the pigment may exceed 3.0 μm, and the fixability may deteriorate. Moreover, the resolution may deteriorate. Meanwhile, when the time of performing the wet dispersion and wet pulverization is excessively long, or when the rotating speed is excessively fast, the average particle diameter ($D_{50}$) of the pigment may be less than 0.1 μm, and the image quality may deteriorate.

Note that, in order to calculate the average particle diameter ($D_{50}$) of the pigment, it is necessary to measure the particle size distribution of the pigment. The particle size distribution of the pigment can be measured, for example, as follows. A predetermined amount of the prepared pigment dispersing element or the manufactured liquid developer is sampled and diluted, hundredfold (volume), with the same carrier fluid as the carrier fluid that is being used in the pigment dispersing element or the liquid developer, and measured with the flow system using the laser diffraction-type particle size distribution measurement device "Master Sizer 2000" manufactured by MALVERN.

The mixing process is a process of consequently manufacturing the liquid developer by mixing the prepared resin solution and the prepared pigment dispersing element at a predetermined mixture ratio (mass ratio).

Examples

The present invention is now explained in further detail with reference to the Examples and Comparative Examples, but the present invention shall not be limited by the following Examples.

(Manufacture of Liquid Developer A)

A resin solution was obtained by dissolving 1.33 parts by mass of a styrene-butadiene elastomer ("Asaprene (registered trademark) T-413" manufactured by Asahi Kasei Chemicals Corporation: styrene content of 30 mass percent) as the styrene elastomer A in 98.67 parts by mass of vegetable oil (medium chain fatty acid triglyceride "Coconard MT" manufactured by Kao Corporation) as the solvent. Meanwhile, a pigment dispersing element was obtained by mixing and dispersing 72 parts by mass of liquid paraffin ("Moresco White P-200" manufactured by Moresco) as the carrier fluid, 20 parts by mass of a cyan pigment (C.I. Pigment Blue 15:3) as the colored particles, and 8 parts by mass of "Antaron (registered trademark) V-216" manufactured by ISP as the dispersion stabilizer using a rocking mill ("RM-10" manufactured by Seiwa Giken Co., Ltd.) at a drive frequency of 60 Hz for 1 hour. The average particle diameter ($D_{50}$) of the pigment in the pigment dispersing element was 0.5 μm. Subsequently, by mixing the resin solution and the pigment dispersing element at a mixture ratio (mass ratio) of 3:1, as shown in Table 1, a cyan liquid developer A containing 5 mass percent of the pigment and 1 mass percent of the styrene elastomer was manufactured.

(Manufacture of Liquid Developer B)

As shown in Table 1, the liquid developer B was manufactured as with the liquid developer A other than using a styrene-butadiene elastomer ("Tufprene (registered trademark)

315P manufactured by Asahi Kasei Chemicals Corporation: styrene content of 20 mass percent") as the styrene elastomer B in substitute for the styrene elastomer A.

(Manufacture of Liquid Developer C)

As shown in Table 1, the liquid developer C containing 5 mass percent of the pigment and 10 mass percent of the styrene elastomer was obtained as with the liquid developer A other than using 13.33 parts by mass of the styrene elastomer A and 86.67 parts by mass of the solvent.

(Manufacture of Liquid Developer D)

As shown in Table 1, the liquid developer D was manufactured as with the liquid developer C other than using the styrene elastomer B in substitute for the styrene elastomer A.

(Manufacture of Liquid Developer E)

As shown in Table 1, the liquid developer E containing 5 mass percent of the pigment and 0.1 mass percent of the styrene elastomer was obtained as with the liquid developer A other than using 0.14 parts by mass of the styrene elastomer A and 99.86 parts by mass of the solvent.

(Manufacture of Liquid Developer F)

As shown in Table 1, the liquid developer F was manufactured as with the liquid developer E other than using the styrene elastomer B in substitute for the styrene elastomer A.

(Manufacture of Liquid Developer G)

As shown in Table 1, the liquid developer G containing 5 mass percent of the pigment and 0.09 mass percent of the styrene elastomer was obtained as with the liquid developer A other than using 0.12 parts by mass of the styrene elastomer A and 99.88 parts by mass of the solvent.

(Manufacture of Liquid Developer H)

As shown in Table 1, the liquid developer H was manufactured as with the liquid developer G other than using the styrene elastomer B in substitute for the styrene elastomer A.

(Manufacture of Liquid Developer I)

As shown in Table 1, the liquid developer I containing 5 mass percent of the pigment and 12 mass percent of the styrene elastomer was obtained as with the liquid developer A other than using 16 parts by mass of the styrene elastomer A and 84 parts by mass of the solvent.

(Manufacture of Liquid Developer J)

As shown in Table 1, the liquid developer J was manufactured as with the liquid developer I other than using the styrene elastomer B in substitute for the styrene elastomer A.

(Manufacture of Liquid Developer K)

A pigment dispersing element was obtained by mixing and dispersing 72 parts by mass of liquid paraffin ("Moresco White P-200" manufactured by Moresco) as the carrier fluid, 20 parts by mass of a cyan pigment (C.I. Pigment Blue 15:3) as the colored particles, and 8 parts by mass of "Antaron (registered trademark) V-216" manufactured by ISP as the dispersion stabilizer using a rocking mill ("RM-10" manufactured by Seiwa Giken Co., Ltd.) at a drive frequency of 60 Hz for 1 hour. The average particle diameter ($D_{50}$) of the pigment in the pigment dispersing element was 0.5 μm. Subsequently, by mixing the vegetable oil (medium chain fatty acid triglyceride "Coconard MT" manufactured by Kao Corporation) and the pigment dispersing element at a mixture ratio (mass ratio) of 3:1, as shown in Table 1, a cyan liquid developer K containing 5 mass percent of the pigment and 0 mass percent of the styrene elastomer was manufactured.

(Formation of Image)

Using the wet-type image forming apparatus (color printer) 1A (an experimental apparatus of the wet-type image forming apparatus manufactured by Kyocera Mita Corporation) shown in FIG. 1 that does not include the fixing part, the cyan liquid developers A to K were placed inside the cyan image forming unit FC, a square solid image (5 cm×5 cm) filled uniformly with a pigment application amount correspond to 0.026 mg/cm$^2$ was formed on quality plain paper (C2 paper manufactured by Oji Paper Co., Ltd.: 90 g/m$^2$) as the sheet. Here, the thickness of the liquid developer layer on the circumferential surface of the developing roller 141 was set to 5 μm. Moreover, the development field to be applied to the developing roller 141 upon forming the image on the surface of the photoconductor drum 10 based on the image data was set to 400 V. Subsequently, the sheet ejected from the ejection part 6 was subject to the following fixability test.

(Fixability Test)

A scratch resistance test was performed in order to evaluate the fixability of the image portion of the sheet ejected from the ejection part 6 to which a solid image was transferred by the secondary transfer part 4. Specifically, a metal columnar weight (diameter of 50 mm with cloth (padding) placed at the bottom face thereof) with a mass of 300 g was placed on the image portion 5 seconds after such image was formed with the secondary transfer part 4, and the weight was moved laterally across the image so that it goes outside the image, and the same movement across the same path was repeated 10 times. In order to observe whether the image was rubbed and scratched with the mass of the weight, the image density of the portion outside the solid image and which is the portion where the weight moved was measured as circumferential image density with a spectrophotometer ("X-rite Spectro Eye" manufactured by Gretag Macbeth). The evaluation standard of the fixability was as follows; namely, "O" was indicated for those with a circumferential image density of less than 0.01, "Δ," was indicated for those with a circumferential image density of 0.01 or more and less than 0.3, and "×" was indicated for those with a circumferential image density of 0.3 or more. Note that this test also doubles as a test of the drying property of the coated layer of the styrene elastomer.

The results are shown in Table 1.

TABLE 1

| LIQUID DEVELOPER | CONTENT (MASS PERCENT) STYRENE ELASTOMER A | STYRENE ELASTOMER B | SOLVENT | CARRIER FLUID | PIGMENT | DISPERSION STABILIZER | PIGMENT AVERAGE PARTICLE DIAMETER ($D_{50}$: μm) | FIXABILITY CIRCUMFERENTIAL IMAGE DENSITY | EVALUATION | SCOPE OF PRESENT INVENTION |
|---|---|---|---|---|---|---|---|---|---|---|
| A | 1 | 0 | 74 | 18 | 5 | 2 | 0.5 | 0.003 | ○ | ○ |
| B | 0 | 1 | 74 | 18 | 5 | 2 | 0.5 | 0.002 | ○ | ○ |
| C | 10 | 0 | 65 | 18 | 5 | 2 | 0.5 | 0.002 | ○ | ○ |
| D | 0 | 10 | 65 | 18 | 5 | 2 | 0.5 | 0.002 | ○ | ○ |
| E | 0.1 | 0 | 74.9 | 18 | 5 | 2 | 0.5 | 0.007 | ○ | ○ |
| F | 0 | 0.1 | 74.9 | 18 | 5 | 2 | 0.5 | 0.006 | ○ | ○ |
| G | 0.09 | 0 | 74.91 | 18 | 5 | 2 | 0.5 | 0.012 | Δ | ○ |

TABLE 1-continued

| LIQUID DEVEL-OPER | CONTENT (MASS PERCENT) STYRENE ELASTO-MER A | STYRENE ELASTO-MER B | SOL-VENT | CARRIER FLUID | PIG-MENT | DISPERSION STABILIZER | PIGMENT AVERAGE PARTICLE DIAMETER ($D_{50}$: μm) | FIXABILITY CIRCUMFER-ENTIAL IMAGE DENSITY | EVALUA-TION | SCOPE OF PRESENT INVEN-TION |
|---|---|---|---|---|---|---|---|---|---|---|
| H | 0 | 0.09 | 74.91 | 18 | 5 | 2 | 0.5 | 0.014 | Δ | ○ |
| I | 12 | 0 | 63 | 18 | 5 | 2 | 0.5 | 0.28 | Δ | ○ |
| J | 0 | 12 | 63 | 18 | 5 | 2 | 0.5 | 0.22 | Δ | ○ |
| K | 0 | 0 | 75 | 18 | 5 | 2 | 0.5 | 0.64 | x | |

(Results and Consideration)

As evident from Table 1, the liquid developers A to J containing styrene elastomer had superior fixability in comparison to the liquid developer K that does not contain styrene elastomer in a liquid developer in which the pigments are dispersed in the carrier fluid.

Among the liquid developers A to J, the liquid developers A to F in which the content of the styrene elastomer is 0.1 to 10 mass percent particularly had superior fixability.

As explained above in detail with specific examples, since the liquid developer according to this embodiment contains an electrically insulating carrier fluid and colored particles dispersed in the carrier fluid and the colored particles are pigments and the liquid developer contains styrene elastomer, the styrene elastomer coats the pigments remaining on the surface of the recording medium and forms a coated layer by remaining on the surface of the recording medium when the carrier fluid is absorbed within the recording medium after the image is transferred to the recording medium, and the pigments are fixed to the recording medium with the coated layer of the styrene elastomer. It is thereby possible to fix the pigments; that is, the image, to the recording medium with non-heating or at low temperature without consuming considerable thermal energy or light energy, and reduce the consumption energy in the wet-type image forming apparatus. Moreover, it is possible to eliminate or simplify the conventional fixing part (fixing device) itself which consumes considerable thermal or light energy, and thereby achieve the simplification and cost reduction of the wet-type image forming apparatus. In addition, since the colored particles will not fall off from the recording medium and the image is not smeared, it is possible to obtain a high quality image.

When the styrene elastomer is a block copolymer having a structure represented by Formula 1 containing a polymer block A made of an aromatic vinyl compound and a polymer block B made of an olefin compound or a conjugated diene compound, a liquid developer with superior fixability can be obtained reliably.

When the styrene elastomer is a styrene-butadiene elastomer in which the polymer block A and the polymer block B have a structure represented by Formula 2, a liquid developer with superior fixability can be obtained even more reliably.

When the content of the styrene elastomer in the liquid developer is 0.1 to 10 mass percent, the favorable drying property of the coated layer and the scratch resistance of the image can be ensured while maintaining superior fixability.

A wet-type image forming apparatus comprising a charging device for charging a surface of a photoconductor drum, an exposure device for forming an electrostatic latent image on the surface of the charged photoconductor drum, a liquid developing device for developing an electrostatic latent image on the surface of the photoconductor drum with a liquid developer, and a transfer device for transferring the developed image to a recording medium, and in which the wet-type image forming apparatus uses the foregoing liquid developer as the liquid developer is a favorable wet-type image forming apparatus from the perspective of energy conservation since the apparatus does not consume considerable thermal or light energy upon performing the fixing process of fixing the transferred image to the recording medium.

Second Embodiment

The liquid developer according to this embodiment is a liquid developer containing an electrically insulating carrier fluid and colored particles dispersed in the carrier fluid, wherein the colored particles are pigments, and wherein the liquid developer contains polyvinyl butyral. Since the polyvinyl butyral coats the pigments remaining on the surface of the recording medium and forms a coated layer by remaining on the surface of the recording medium when the carrier fluid is absorbed within the recording medium after the image is transferred to the recording medium, the pigments are fixed to the recording medium with the coated layer of the polyvinyl butyral. It is thereby possible to fix the pigments; that is, the image, to the recording medium without consuming considerable thermal energy or light energy, and reduce the consumption energy in the wet-type image forming apparatus.

<Liquid Developing Device and Wet-Type Image Forming Apparatus>

Since the liquid developing device and the wet-type image forming apparatus according to this embodiment are the same as the first embodiment other than that, as the liquid developer, a liquid developer containing polyvinyl butyral is used in substitute for the liquid developer containing styrene elastomer, the explanation thereof is omitted.

<Wet-Type Image Forming Method>

The wet-type image forming method according to this embodiment is achieved by using the wet-type image forming apparatus 1A and forming an image on a sheet. Specifically, the wet-type image forming method according to this embodiment includes a charging process of charging the surface of the photoconductor drum 10, an exposure process of forming an electrostatic latent image on the surface of the charged photoconductor drum 10, a development process of forming an image by developing the electrostatic latent image on the surface of the photoconductor drum 10 with a liquid developer containing an electrically insulating carrier fluid and colored particles dispersed in the carrier fluid in which the colored particles are pigments and the liquid developer contains polyvinyl butyral, a transfer process of transferring the developed image onto a sheet, and an ejecting process of ejecting the image-transferred sheet from the ejection part 6. The wet-type image forming method according to this embodiment is a favorable wet-type image forming method from the perspective of energy conservation capable of fixing the transferred image to the sheet, without having to consume considerable thermal or light energy upon performing the fixing process of fixing the transferred image to the sheet, by using the liquid developer explained below.

<Liquid Developer>

The liquid developer according to this embodiment contains, as its basic configuration, an electrically insulating carrier fluid and colored particles dispersed in the carrier fluid. The colored particles are pigments, and the liquid developer contains polyvinyl butyral. Here, preferably, the carrier fluid is at least one selected from a group consisting of triethyleneglycol bis(2-ethylhexanate), castor oil and epoxidized soybean oil. Moreover, the content of the polyvinyl butyral is preferably 1 to 10 mass percent.

[Carrier Fluid]

Generally speaking, an electrically insulating carrier fluid functions as a liquid carrier, and is used for increasing the electrical insulation of the obtained liquid developer. As the electrically insulating carrier fluid, an organic solvent possessing electrical insulation and, for instance, having a volume resistance of $10^{10}$ Ω·cm or more (in other words, electrical conductivity of 100 pS/cm or less) at 25° C. is preferably used. As this kind of electrically insulating organic solvent, there is aliphatic hydrocarbon that is a liquid at normal temperature, and, for example, liquid n-paraffinic hydrocarbon, liquid iso-paraffinic hydrocarbon or the mixture thereof, liquid halogenated aliphatic hydrocarbon and the like are preferably used. Specifically, n-hexane, n-heptane, n-octane, nonane, decane, dodecane, cyclohexane, perchloroethylene, trichloroethane and the like may be used. Moreover, aliphatic hydrocarbon with a branched-chain is particularly favorable. Commercially available aliphatic hydrocarbon with a branched-chain may be used, and, for example, "Isopar G," "Isopar H," "Isopar K," "Isopar L," "Isopar M," "Isopar V" manufactured by Exxon Mobile can be preferably used. Moreover, liquid paraffin "Moresco White P-40," "Moresco White P-70," "Moresco White P-200" manufactured by Moresco (the former Matsumura Oil Research Corporation) can also be preferably used. Moreover, liquid paraffin "Cosmo White P-60," "Cosmo White P-70," "Cosmo White P-120" manufactured by Cosmo Oil, Ltd. can also be preferably used.

As the carrier fluid that can be used in this embodiment, in addition to the foregoing physical properties, a carrier fluid capable of dissolving polyvinyl butyral (solubility of polyvinyl butyral is relatively high) is preferably used. Moreover, from the perspective of VOC (volatile organic compounds), a carrier fluid with relatively low volatility is preferably used. As the foregoing example, for instance, alcohols, vegetable oils, fatty acid esters and the like with a boiling point of 200° C. or higher can be preferably used. In particular, triethyleneglycol bis(2-ethylhexanate), castor oil (fatty acid composition is unsaturated fatty acid (87% ricinoleic acid, 7% oleic acid, 3% linoleic acid) and saturated fatty acid (3% palmitin acid, stearic acid and the like)), and epoxidized soybean oil (fatty acid composition of the soybean oil is approximately 50% linoleic acid, 20% or more oleic acid, approximately 10% palmitin acid) are preferably used. These may be used independently or as a mixture depending on the circumstances.

In this embodiment, so as long as the polyvinyl butyral dissolves in the carrier fluid, a carrier fluid in which the solubility of polyvinyl butyral is relatively high may be used independently, or a carrier fluid in which the solubility of polyvinyl butyral is relatively high and a carrier fluid in which the solubility of polyvinyl butyral is relatively low may be mixed and used.

[Colored Particles]

The explanation is omitted since they are the same as the first embodiment.

[Dispersion Stabilizer]

The explanation is omitted since it is the same as the first embodiment.

[Polyvinyl Butyral]

The liquid developer according to this embodiment contains polyvinyl butyral. Polyvinyl butyral (butyral resin or alkyl acetalized polyvinyl alcohol) is, as shown in Formula 3, a copolymer of a hydrophilic vinyl alcohol unit having a hydroxyl group, a hydrophobic vinyl acetal unit having a butyral group, and a vinyl acetate unit having an acetyl group with intermediate properties of a vinyl alcohol unit and a vinyl acetal unit. In the liquid developer according to this embodiment, polyvinyl butyral with a degree of butyralization (which defines the ratio of the hydrophilic part and the hydrophobic part) of 60 to 85 mol % is preferable since it yields superior coated layer forming performance (film formation properties). Since polyvinyl butyral includes a vinyl acetal unit showing solubility to the nonpolar solvent, and a vinyl alcohol unit which improves the binding capacity to the recording medium such as paper, polyvinyl butyral yields high affinity to both the carrier fluid and the recording medium.

(Formula 3)

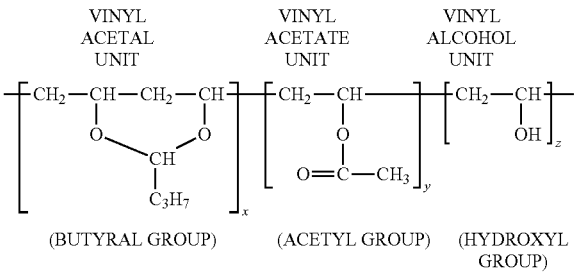

An example of a specific method of blending the polyvinyl butyral with the liquid developer in this embodiment is now explained. In this embodiment, it is preferable to use, as the carrier fluid, a carrier fluid of a type capable of dissolving polyvinyl butyral. As this kind of carrier fluid, as described above, for example, alcohols, vegetable oils, fatty acid esters and the like with a boiling point of 200° C. or higher can be preferably used. In particular, triethyleneglycol bis(2-ethylhexanate), castor oil, and epoxidized soybean oil are preferably used. Moreover, so as long as the polyvinyl butyral dissolves in the carrier fluid, a carrier fluid in which the solubility of polyvinyl butyral is relatively high may be used independently, or a carrier fluid in which the solubility of polyvinyl butyral is relatively high and a carrier fluid in which the solubility of polyvinyl butyral is relatively low may be mixed and used.

In the liquid developer according to this embodiment, the polyvinyl butyral exists in a state of being dissolved in the carrier fluid. Consequently, the mechanism of fixing the image to the sheet is basically as follows. Specifically, the polyvinyl butyral in the liquid developer stored in the developing vessel 140 of the liquid developing device 14 exists in a state of being dissolved in the carrier fluid. This state is the same on the developing roller 141, on the photoconductor drum 10, and on the intermediate transfer belt 21. Needless to say, although the ratio of the carrier fluid in the liquid developer will gradually decrease, the polyvinyl butyral in the liquid developer is still in the state of being dissolved in the carrier fluid. Subsequently, when the image is transferred from the intermediate transfer belt 21 to the sheet by the secondary transfer part 4, the polyvinyl butyral and the colored particles (pigments) in the carrier fluid remain on the surface of the sheet, and the carrier fluid is absorbed within the sheet. Pursuant thereto, the concentration of the polyvinyl butyral in the carrier fluid on the surface of the sheet will increase, and exceeds the saturated solubility. The polyvinyl butyral that exceeds the saturated solubility coats the pigments remaining on the surface of the sheet and forms a coated layer by remaining on the surface of the sheet. Since the pigments are fixed to the sheet with the coated layer of the polyvinyl butyral, it is possible to fix the pigments; that is, the image that has been transferred to the sheet, to the sheet without consuming considerable thermal energy or light energy, and reduce the consumption energy in the wet-type image forming apparatus. This is extremely effective from the perspective of environmental protection. Moreover, since the wet-type image forming apparatus 1A according to this embodiment no longer needs the conventional fixing part 5 which uses thermal or light energy, it is possible to seek the simplification and cost reduction of the wet-type image forming apparatus 1A.

Note that a state where the polyvinyl butyral is dissolved in the carrier fluid also includes a gelled state. Depending on the type and molecular weight of the polyvinyl butyral, the polyvinyl butyrals could mutually entwine in the carrier fluid and become a gelled state with relatively low fluidity. For example, when the concentration of the polyvinyl butyral is high or when the affinity of the polyvinyl butyral and the solvent is low, or when the temperature is low, the polyvinyl butyral often becomes a gelled state. Meanwhile, when the polyvinyl butyrals hardly become mutually entwined in the carrier fluid and the fluidity is relatively high, the polyvinyl butyral may be in a liquid state.

There is no particular limitation on the polyvinyl butyral that can be used in this embodiment. For example, "Mowital (registered trademark)" B20H, B30B, B30H, B60T, B60H, B60HH, B70H manufactured by Hoechst AG; "S-rec (registered trademark)" BL-1 (degree of butyralization: 63±3 mol %), BL-2 (degree of butyralization: 63±3 mol %), BL-S (degree of butyralization: 70 mol % or more), BL-L, BH-3 (degree of butyralization: 65±3 mol %), BM-1 (degree of butyralization: 65±3 mol %), BM-2 (degree of butyralization: 68±3 mol %), BM-5 (degree of butyralization: 63±3 mol %), BM-S manufactured by Sekisui Chemical Co., Ltd.; and "Denka Butyral" #2000-L, #3000-1, #3000-2, #3000-3, #3000-4, #3000-K, #4000-1, #5000-A, #6000-C manufactured by Denki Kagaku Kogyo K.K. may be preferably used. These may be used independently or as a combination of two or more types.

The content of the polyvinyl butyral in the liquid developer is preferably 1 to 10 mass percent, more preferably 3 mass percent or more and/or 8 mass percent or less, still more preferably 5 mass percent or more and/or 6 mass percent or less. When the content of the polyvinyl butyral is less than 1 mass percent, the amount of the polyvinyl butyral coated layer remaining on the surface of the sheet may become too small, and the film formation properties and consequently the fixability may become considerably insufficient. When the content of the polyvinyl butyral exceeds 10 mass percent, the amount of the polyvinyl butyral coated layer remaining on the surface of the sheet may become too great, and the drying property of the coated layer may deteriorate excessively, the viscosity (tack properties) of the coated layer may increase excessively, the rubber elasticity of the coated layer may increase excessively, and the scratch resistance of the image may deteriorate excessively.

[Manufacturing Method]

The liquid developer according to this embodiment can be manufactured by sufficiently dissolving or mixing/dispersing the carrier fluid, the pigment, the polyvinyl butyral, and, depending on the circumstances, the dispersion stabilizer using a ball mill, sand grinder, dyno-mill, or rocking mill (or a media disperser using zirconia beads or the like) for a period of several hours or more than 10 hours depending on the circumstances.

Based on the foregoing mixture and dispersion, the pigment particles are finely pulverized. The time and rotating speed of mixture and dispersion are controlled so that the average particle diameter ($D_{50}$) of the pigment becomes, as described above, preferably 0.1 to 3.0 μm. When the dispersion time is excessively short, or when the rotating speed is excessively slow, the average particle diameter ($D_{50}$) of the pigment may exceed 3.0 μm, and the fixability may deteriorate as described above. Meanwhile, when the dispersion time is excessively long, or when the rotating speed is excessively fast, the average particle diameter ($D_{50}$) of the pigment may be less than 0.1 μm, and, as described above, the development performance may be insufficient and the image density may decrease, and more fogging may occur.

Note that, in order to calculate the average particle diameter ($D_{50}$) of the pigment, it is necessary to measure the particle size distribution of the pigment. The particle size distribution of the pigment can be measured, for example, as follows. A predetermined amount of the manufactured liquid developer is sampled and diluted, hundredfold (volume), with the same carrier fluid as the carrier fluid that is being used in the liquid developer, and measured with the flow system using the laser diffraction-type particle size distribution measurement device "Master Sizer 2000" manufactured by MALVERN.

Examples

The present invention is now explained in further detail with reference to the Examples and Comparative Examples, but the present invention shall not be limited by the following Examples.

(Manufacture of Liquid Developer A)

A cyan liquid developer A was manufactured by dissolving 1 part by mass of polyvinyl butyral ("S-rec (registered trademark) BL-S" manufactured by Sekisui Chemical Co., Ltd.) in 94 parts by mass of castor oil (refined castor oil "LAV" manufactured by Itoh Oil Chemicals Co., Ltd.) as the carrier fluid, and thereafter mixing and dispersing 5 parts by mass of a cyan pigment (C.I. Pigment Blue 15:3) as the colored particles. The average particle diameter ($D_{50}$) of the pigment in the liquid developer A was 0.5 μm.

(Manufacture of Liquid Developers B to E)

Cyan liquid developers B to E were manufactured with the composition shown in Table 2 in accordance with the liquid developer A. However, the liquid developer E does not contain polyvinyl butyral.

(Formation of Image)

Using the wet-type image forming apparatus (color printer) 1A (an experimental apparatus of the wet-type image forming apparatus manufactured by Kyocera Mita Corporation) shown in FIG. 1 that does not include the fixing part, the cyan liquid developers A to E were placed inside the cyan image forming unit FC, a square solid image (5 cm×5 cm) filled uniformly with a pigment application amount correspond to 0.026 mg/cm$^2$ was formed on quality plain paper (C2 paper manufactured by Oji Paper Co., Ltd.: 90 g/m$^2$) as the sheet. Here, the thickness of the liquid developer layer on the circumferential surface of the developing roller 141 was set to 5 μm. Moreover, the development field to be applied to the developing roller 141 upon forming the image on the surface of the photoconductor drum 10 based on the image data was set to 400 V. Subsequently, the sheet ejected from the ejection part 6 was subject to the following fixability test.

(Fixability Test)

A scratch resistance test was performed in order to evaluate the fixability of the image portion of the sheet ejected from the ejection part 6 to which a solid image was transferred by the secondary transfer part 4. Specifically, a metal columnar weight (diameter of 50 mm with cloth (padding) placed at the bottom face thereof) with a mass of 300 g was placed on the image portion 5 seconds after such image was formed with the secondary transfer part 4, and the weight was moved laterally across the image so that it goes outside the image, and the same movement across the same path was repeated 10 times. In order to observe whether the image was rubbed and scratched with the mass of the weight, the image density of the portion outside the solid image and which is the portion where the weight moved was measured as circumferential image density with a spectrophotometer ("X-rite Spectro Eye" manufactured by Gretag Macbeth). The evaluation standard of the fixability was as follows; namely, "O" was indicated for those with a circumferential image density of less than 0.01, "Δ," was indicated for those with a circumferential image density of 0.01 or more and less than 0.3, and "×" was indicated for those with a circumferential image density of 0.3 or more. Note that this test also doubles as a test of the drying property of the coated layer of the polyvinyl butyral.

The results are shown in Table 2.

TABLE 2

| LIQUID DEVELOPER | CONTENT (MASS PERCENT) CARRIER FLUID | PIGMENT | POLYVINYL BUTYRAL | PIGMENT AVERAGE PARTICLE DIAMETER ($D_{50}$: μm) | FIXABILITY CIRCUMFERENTIAL IMAGE DENSITY | EVALUATION | SCOPE OF PRESENT INVENTION |
|---|---|---|---|---|---|---|---|
| A | 94 | 5 | 1 | 0.5 | 0.002 | ○ | ○ |
| B | 85 | 5 | 10 | 0.4 | 0.004 | ○ | ○ |
| C | 94.2 | 5 | 0.8 | 0.5 | 0.21 | Δ | ○ |
| D | 84 | 5 | 11 | 0.4 | 0.24 | Δ | ○ |
| E | 95 | 5 | 0 | 0.5 | 0.61 | x | |

(Results and Consideration)

As evident from Table 2, the liquid developers A to D containing polyvinyl butyral had superior fixability in comparison to the liquid developer E that does not contain polyvinyl butyral in a liquid developer in which the pigments are dispersed in the carrier fluid.

Among the liquid developers A to D, the liquid developers A and B in which the content of the polyvinyl butyral is 1 to 10 mass percent particularly had superior fixability.

Note that, with a liquid developer that was developed with the same composition as the liquid developer A other than using octylic alcohol ("Kalcol 0880" manufactured by Kao Corporation) in substitute for the castor oil as the carrier fluid, there were specks (fogging) in the non-image forming region around the solid image, and it was not possible to form an image that could be evaluated. Consequently, it has been confirmed that octylic alcohol is not favorable as a carrier fluid for dissolving the polyvinyl butyral.

As explained above in detail with specific examples, since the liquid developer according to this embodiment contains an electrically insulating carrier fluid and colored particles dispersed in the carrier fluid and the colored particles are pigments and the liquid developer contains polyvinyl butyral, the polyvinyl butyral coats the pigments remaining on the surface of the recording medium and forms a coated layer by remaining on the surface of the recording medium when the carrier fluid is absorbed within the recording medium after the image is transferred to the recording medium, and the pigments are fixed to the recording medium with the coated layer of the polyvinyl butyral. It is thereby possible to fix the pigments; that is, the image, to the recording medium with non-heating or at low temperature without consuming considerable thermal energy or light energy, and reduce the consumption energy in the wet-type image forming apparatus. Moreover, it is possible to eliminate or simplify the conventional fixing part (fixing device) itself which consumes considerable thermal or light energy, and thereby achieve the simplification and cost reduction of the wet-type image forming apparatus. In addition, since the colored particles will not fall off from the recording medium and the image is not smeared, it is possible to obtain a high quality image.

When, as the carrier fluid, at least one carrier fluid selected from a group consisting of triethyleneglycol bis(2-ethylhexanate), castor oil and epoxidized soybean oil is used, it is possible to favorably dissolve the polyvinyl butyral and reliably obtain a liquid developer with superior fixability.

When the content of the polyvinyl butyral in the liquid developer is 1 to 10 mass percent, the favorable drying property of the coated layer and the scratch resistance of the image can be ensured while maintaining superior fixability.

A wet-type image forming apparatus comprising a charging device for charging a surface of a photoconductor drum, an exposure device for forming an electrostatic latent image on the surface of the charged photoconductor drum, a liquid developing device for developing an electrostatic latent image on the surface of the photoconductor drum with a liquid developer, and a transfer device for transferring the developed image to a recording medium, and in which the wet-type image forming apparatus uses the foregoing liquid developer as the liquid developer is a favorable wet-type image forming apparatus from the perspective of energy conservation since the apparatus does not consume considerable thermal or light energy upon performing the fixing process of fixing the transferred image to the recording medium.

Third Embodiment

The liquid developer according to this embodiment is a liquid developer containing an electrically insulating carrier fluid and colored particles dispersed in the carrier fluid, wherein the liquid developer contains cyclic olefin copolymer, and wherein the colored particles are pigments. Since the cyclic olefin copolymer coats the pigments remaining on the surface of the recording medium and forms a coated layer by remaining on the surface of the recording medium when the carrier fluid is absorbed within the recording medium after the image is transferred to the recording medium, the pigments are fixed to the recording medium with the coated layer of the cyclic olefin copolymer. It is thereby possible to fix the pigments; that is, the image, to the recording medium without consuming considerable thermal energy or light energy, and reduce the consumption energy in the wet-type image forming apparatus.

<Liquid Developing Device and Wet-Type Image Forming Apparatus>

Since the liquid developing device and the wet-type image forming apparatus according to this embodiment are the same as the first embodiment other than that, as the liquid developer, a liquid developer containing cyclic olefin copolymer is used in substitute for the liquid developer containing styrene elastomer, the explanation thereof is omitted.

<Wet-Type Image Forming Method>

The wet-type image forming method according to this embodiment is achieved by using the wet-type image forming apparatus 1A and forming an image on a sheet. Specifically, the wet-type image forming method according to this embodiment includes a charging process of charging the surface of the photoconductor drum 10, an exposure process of forming an electrostatic latent image on the surface of the charged photoconductor drum 10, a development process of forming an image by developing the electrostatic latent image on the surface of the photoconductor drum 10 with a liquid developer containing an electrically insulating carrier fluid and colored particles dispersed in the carrier fluid in which the colored particles are pigments and the liquid developer contains cyclic olefin copolymer, a transfer process of transferring the developed image onto a sheet, and an ejecting process of ejecting the image-transferred sheet from the ejection part 6. The wet-type image forming method according to this embodiment is a favorable wet-type image forming method from the perspective of energy conservation capable of fixing the transferred image to the sheet, without having to consume considerable thermal or light energy upon performing the fixing process of fixing the transferred image to the sheet, by using the liquid developer explained below.

<Liquid Developer>

The liquid developer according to this embodiment contains, as its basic configuration, an electrically insulating carrier fluid and colored particles dispersed in the carrier fluid. The liquid developer contains cyclic olefin copolymer. The colored particles are pigments. Preferably, the cyclic olefin copolymer is a copolymer of norbornene and ethylene. The content of the cyclic olefin copolymer in the liquid developer is preferably 2 to 8 mass percent.

[Carrier Fluid]

Generally speaking, an electrically insulating carrier fluid functions as a liquid carrier, and is used for increasing the electrical insulation of the obtained liquid developer. As the electrically insulating carrier fluid, an organic solvent possessing electrical insulation and, for instance, having a volume resistance of $10^{10}$ Ω·cm or more (in other words, electrical conductivity of 100 pS/cm or less) at 25° C. is preferably used. As this kind of electrically insulating organic solvent, there is aliphatic hydrocarbon that is a liquid at normal temperature, and, for example, liquid n-paraffinic hydrocarbon, liquid iso-paraffinic hydrocarbon or the mixture thereof, liquid halogenated aliphatic hydrocarbon and the like are preferably used. Specifically, n-hexane, n-heptane, n-octane, nonane, decane, dodecane, hexadecane, heptadecane, cyclohexane, perchloroethylene, trichloroethane and the like may be used. Moreover, aliphatic hydrocarbon with a branched-chain is particularly favorable. From the perspective of VOC (volatile organic compounds), a carrier fluid with relatively low volatility (for example, with a boiling point of 200° C. or higher) is preferably used, and, for example, liquid paraffin and the like containing relatively large amounts of aliphatic hydrocarbon with a carbon number of 16 or higher are preferably used.

Commercially available carrier fluids may be used, and, for example, "Isopar G," "Isopar H," "Isopar K," "Isopar L," "Isopar M," "Isopar V" manufactured by Exxon Mobile can be preferably used. Moreover, liquid paraffin "Moresco White P-40," "Moresco White P-70," "Moresco White P-200" manufactured by Moresco (the former Matsumura Oil Research Corporation) can also be preferably used. Moreover, liquid paraffin "Cosmo White P-60," "Cosmo White P-70," "Cosmo White P-120" manufactured by Cosmo Oil, Ltd. can also be preferably used.

As the carrier fluid that can be used in this embodiment, in addition to the foregoing physical properties, a carrier fluid capable of dissolving cyclic olefin copolymer (solubility of cyclic olefin copolymer is relatively high) is preferably used. In this embodiment, so as long as the cyclic olefin copolymer dissolves in the carrier fluid, a carrier fluid in which the solubility of cyclic olefin copolymer is relatively high may be used independently, or a carrier fluid in which the solubility of cyclic olefin copolymer is relatively high and a carrier fluid in which the solubility of cyclic olefin copolymer is relatively low may be mixed and used. Here, it is necessary to pay attention so that, depending on the type of carrier fluid that is used, the electrical conductivity of the overall carrier fluid and consequently the electrical conductivity of the liquid developer may not become excessively high.

[Colored Particles]

The explanation is omitted since they are the same as the first embodiment.

[Dispersion Stabilizer]

The explanation is omitted since it is the same as the first embodiment.

[Cyclic Olefin Copolymer]

The liquid developer according to this embodiment contains cyclic olefin copolymer. Cyclic olefin copolymer has a cyclic olefin skeleton as its main chain, and is an amorphous thermoplastic olefin-based resin that is free from any environmental load substance, and has superior transparency, lightweight properties, low water absorbability and the like. More specifically, in this embodiment, the cyclic olefin copolymer is a macromolecular compound in which its main chain is made of a carbon-carbon bond, and has a cyclic hydrocarbon structure at least in a part of the main chain. This cyclic hydrocarbon structure is introduced by using, as a monomer, a compound (cyclic olefin) with at least one olefinic double bond in the cyclic hydrocarbon structure as represented with norbornene or tetracyclododecene.

As the cyclic olefin copolymer that can be used in this embodiment, on the condition that the cyclic olefin copolymer can stably exist for a long period of time in a dissolved state in the carrier fluid, and that the cyclic olefin copolymer can form a coated layer by remaining on the surface of the sheet when the concentration of the cyclic olefin copolymer in the carrier fluid on the surface of the sheet increases and exceeds the saturated solubility after the image is transferred to the sheet, for example, (1) addition (co)polymer of cyclic olefin or its hydrogen additive, (2) addition copolymer of cyclic olefin and α-olefin or its hydrogen additive, (3) ring-opening (co)polymer of cyclic olefin or its hydrogen additive, and the like may be used.

As specific examples of the cyclic olefin, there are, for example:

(a) cyclopentene, cyclohexene, cyclooctene;

(b) one-ring cyclic olefin such as cyclopentadiene, 1,3-cyclohexadiene;

(c) two-ring cyclic olefin such as bicyclo[2.2.1]hepta-2-en (norbornene), 5-methyl-bicyclo[2.2.1]hepta-2-en, 5,5-dimethyl-bicyclo[2.2.1]hepta-2-en, 5-ethyl-bicyclo[2.2.1]hepta-2-en, 5-butyl-bicyclo[2.2.1]hepta-2-en, 5-ethylidene-bicyclo[2.2.1]hepta-2-en, 5-hexyl-bicyclo[2.2.1]hepta-2-en, 5-octyl-bicyclo[2.2.1]hepta-2-en, 5-octadecyl-bicyclo[2.2.1]hepta-2-en, 5-methylidyne-bicyclo[2.2.1]hepta-2-en, 5-vinyl-bicyclo[2.2.1]hepta-2-en, 5-propenyl-bicyclo[2.2.1]hepta-2-en;

(d) tricyclo[4.3.0.12,5]deca-3,7-diene (dicyclopentadiene), tricyclo[4.3.0.12,5]deca-3-en;

(e) tricyclo[4.4.0.12,5]undeca-3,7-diene or tricyclo[4.4.0.12,5]undeca-3,8-diene or tricyclo[4.4.0.12, 5]undeca-3-en as their partial hydrogen additive (or additive of cyclopentadiene and cyclohexene);

(f) three-ring cyclic olefin such as 5-cyclopentyl-bicyclo[2.2.1]hepta-2-en, 5-cyclohexyl-bicyclo[2.2.1]hepta-2-en, 5-cyclohexenylbicyclo[2.2.1]hepta-2-en, 5-phenyl-bicyclo[2.2.1]hepta-2-en;

(g) four-ring cyclic olefin such as tetracyclo[4.4.0.12, 5.17, 10]dodeca-3-en (tetracyclododecene), 8-methyltetracyclo[4.4.0.12,5.17,10]dodeca-3-en, 8-ethyltetracyclo[4.4.0.12, 5.17,10]dodeca-3-en, 8-methylidynetetracyclo[4.4.0.12, 5.17,10]dodeca-3-en, 8-ethylidenetetracyclo[4.4.0.12,5.17, 10]dodeca-3-en, 8-vinyltetracyclo[4, 4.0.12,5.17,10]dodeca-3-en, 8-propenyl-tetracyclo[4.4.0.12,5.17,10]dodeca-3-en;

(h) 8-cyclopentyl-tetracyclo[4.4.0.12,5.17,10]dodeca-3-en, 8-cyclohexyl-tetracyclo[4.4.0.12,5.17,10]dodeca-3-en, 8-cyclohexenyl-tetracyclo[4.4.0.12,5.17,10]dodeca-3-en, 8-phenyl-cyclopentyl-tetracyclo[4.4.0.12,5.17,10]dodeca-3-en;

(i) tetracyclo[7.4.13,6.01,9.02,7]tetradeca-4,9,11,13-tetraen (1,4-methano-1,4,4a,9a-tetrahydrofluorene), tetracyclo[8.4.14,7.01, 10.03,8]pentadeca-5, 10, 12,14-tetraen (1,4-methano-1,4,4a,5,10,10a-hexahydroanthracene);

(j) pentacyclo[6.6.1.13,6.02,7.09,14]-4-hexadecene, pentacyclo[6.5.1.13,6.02,7.09, 13]-4-pentadecene, pentacyclo[7.4.0.02,7.13,6.110,13]-4-pentadecene; heptacyclo[8.7.0.12,9.14,7.111,17.03,8.012,16]-5-eicosen, heptacyclo[8.7.0.12,9.03,8.14,7.012,17.113,16]-14-eicosen; and (k) multi-ring cyclic olefin such as tetramer of cyclopentadiene and the like. These cyclic olefins may be used independently or as a combination of two or more types.

As the α-olefin, an α-olefin with a carbon number of 2 to 20, preferably 2 to 8 is preferably used, and, as specific examples thereof, there are, for example, ethylene, propylene, 1-butene, 1-pentene, 1-hexene, 3-methyl-1-butene, 3-methyl-1-pentene, 3-ethyl-1-pentene, 4-methyl-1-pentene, 4-methyl-1-hexene, 4,4-dimethyl-1-hexene, 4,4-dimethyl-1-pentene, 4-ethyl-1-hexene, 3-ethyl-1-hexene, 1-octene, 1-decene, 1-dodecene, 1-tetradecene, 1-hexadecene, 1-octadecene, 1-eicosen and the like. These olefins may be used independently or as a combination of two or more types.

In this embodiment, there is no particular limitation in the polymerization method of the cyclic olefin, the polymerization method of cyclic olefin and α-olefin, and the hydrogenation method of the obtained polymer, and conventionally known methods may be used.

In this embodiment, there is no particular limitation on the structure of the cyclic olefin copolymer, and it may be a chain shape, a branched shape, or a bridge shape, but it is preferably a normal chain shape.

In this embodiment, as the cyclic olefin copolymer, for example, a copolymer of norbornene and ethylene, or a copolymer of tetracyclododecene and ethylene is preferably used, but the copolymer of norbornene and ethylene is more preferable. The content rate of the norbornene in the copolymer in the foregoing case is preferably 60 to 82 mass percent, more preferably 60 to 79 mass percent, even more preferably 60 to 76 mass percent, and most preferably 60 to 65 mass percent. When the norbornene content rate is less than 60 mass percent, the glass-transition temperature of the coated layer of the cyclic olefin copolymer becomes too low, and the firm formation properties of the cyclic olefin copolymer coated layer tend to deteriorate. When the norbornene content rate exceeds 82 mass percent, the glass-transition temperature of the coated layer of the cyclic olefin copolymer becomes too high, and the fixability of the pigment; that is, the image, with the cyclic olefin copolymer coated layer tends to deteriorate. Moreover, the solubility of the cyclic olefin copolymer in the carrier fluid may become excessively low.

In the liquid developer according to this embodiment, the cyclic olefin copolymer exists in a state of being dissolved in the carrier fluid. Consequently, the mechanism of fixing the image to the sheet is basically as follows. Specifically, the cyclic olefin copolymer in the liquid developer stored in the developing vessel 140 of the liquid developing device 14 exists in a state of being dissolved in the carrier fluid. This state is the same on the developing roller 141, on the photoconductor drum 10, and on the intermediate transfer belt 21. Needless to say, although the ratio of the carrier fluid in the liquid developer will gradually decrease, the cyclic olefin copolymer in the liquid developer is still in the state of being dissolved in the carrier fluid. Subsequently, when the image is transferred from the intermediate transfer belt 21 to the sheet by the secondary transfer part 4, the cyclic olefin copolymer and the colored particles (pigments) in the carrier fluid remain on the surface of the sheet, and the carrier fluid is absorbed within the sheet. Pursuant thereto, the concentration of the cyclic olefin copolymer in the carrier fluid on the surface of the sheet will increase, and exceeds the saturated solubility. The cyclic olefin copolymer that exceeds the saturated solubility coats the pigments remaining on the surface of the sheet and forms a coated layer by remaining on the surface of the sheet. Since the pigments are fixed to the sheet with the coated layer of the cyclic olefin copolymer, it is possible to fix the pigments; that is, the image that has been transferred to the sheet, to the sheet without consuming considerable thermal energy or light energy, and reduce the consumption energy in the wet-type image forming apparatus. This is extremely effective from the perspective of environmental protection. Moreover, since the wet-type image forming apparatus 1A according to this embodiment no longer needs the conventional fixing part 5 which uses thermal or light energy, it is possible to seek the simplification and cost reduction of the wet-type image forming apparatus 1A.

Note that a state where the cyclic olefin copolymer is dissolved in the carrier fluid also includes a gelled state. Depending on the type and molecular weight of the cyclic olefin copolymer, the cyclic olefin copolymers could mutually entwine in the carrier fluid and become a gelled state with relatively low fluidity. For example, when the concentration of the cyclic olefin copolymer is high or when the affinity of the cyclic olefin copolymer and the solvent is low, or when the temperature is low, the cyclic olefin copolymer often becomes a gelled state. Meanwhile, when the cyclic olefin copolymers hardly become mutually entwined in the carrier fluid and the fluidity is relatively high, the cyclic olefin copolymer may be in a liquid state.

A commercially available cyclic olefin copolymer can be used in this embodiment. For example, as a copolymer of norbornene and ethylene, "TOPAS (registered trademark) TM" (norbornene content rate: approximately 60 mass percent, glass-transition temperature: approximately 60° C.), "TOPAS (registered trademark) TB" (norbornene content rate: approximately 60 mass percent, glass-transition temperature: approximately 60° C.), "TOPAS (registered trademark) 8007" (norbornene content rate: approximately 65 mass percent, glass-transition temperature: approximately 80° C.), "TOPAS (registered trademark) 5013" (norbornene content rate: approximately 76 mass percent, glass-transition temperature: approximately 140° C.), "TOPAS (registered trademark) 6013" (norbornene content rate: approximately 76 mass percent, glass-transition temperature: approximately 140° C.), "TOPAS (registered trademark) 6015" (norbornene content rate: approximately 79 mass percent, glass-transition temperature: approximately 160° C.), and "TOPAS (registered trademark) 6017" (norbornene content rate: approximately 82 mass percent, glass-transition temperature: approximately 180° C.) manufactured by Topas Advanced Polymers GmbH may be preferably used. These may be used independently or as a combination of two or more types depending on the circumstances.

The content of the cyclic olefin copolymer in the liquid developer is preferably 2 to 8 mass percent, more preferably 3 mass percent or more and/or 6 mass percent or less, still more preferably 3.5 mass percent or more and/or 4 mass percent or less. When the content of the cyclic olefin copolymer is less than 2 mass percent, the amount of the cyclic olefin copolymer coated layer remaining on the surface of the sheet may become too small, and the film formation properties and consequently the fixability may become considerably insufficient. When the content of the cyclic olefin copolymer exceeds 8 mass percent, the amount of the cyclic olefin copolymer coated layer remaining on the surface of the sheet may become too great, and the drying property of the coated layer may deteriorate excessively, the viscosity (tack properties) of the coated layer may increase excessively, the rubber elasticity of the coated layer may increase excessively, and the scratch resistance of the image may deteriorate excessively.

[Manufacturing Method]

Since the manufacturing method is the same as the second embodiment other than using cyclic olefin copolymer in substitute for the polyvinyl butyral, the explanation thereof is omitted.

However, in this embodiment, the liquid developer can be manufactured by mixing and dispersing a pigment (together with a dispersion stabilizer depending on the circumstances) after dissolving the cyclic olefin copolymer in the carrier fluid, or the liquid developer can be manufactured by preparing, in advance, a resin solution (a solution with cyclic olefin copolymer dissolved in the carrier fluid in the third embodiment) and a pigment dispersing element (with a pigment mixed and dispersed in the carrier fluid (together with a dispersion stabilizer depending on the circumstances)), and mixing these at a suitable mixture ratio (mass ratio).

Note that, in order to calculate the average particle diameter ($D_{50}$) of the pigment, it is necessary to measure the particle size distribution of the pigment. The particle size distribution of the pigment can be measured, for example, as follows. A predetermined amount of the manufactured liquid developer or the prepared pigment dispersing element is sampled and diluted, tenfold to hundredfold (volume), with the same carrier fluid as the carrier fluid that is being used in the liquid developer or the pigment dispersing element, and measured with the flow system using the laser diffraction-type particle size distribution measurement device "Master Sizer 2000" manufactured by MALVERN.

Examples

The present invention is now explained in further detail with reference to the Examples and Comparative Examples, but the present invention shall not be limited by the following Examples.

(Manufacture of Liquid Developer A)

A resin solution was prepared by dissolving 5 parts by mass of a copolymer of norbornene and ethylene ("TOPAS (registered trademark) TM" manufactured by Topas Advanced Polymers GmbH (norbornene content rate: approximately 60 mass percent, glass-transition temperature: approximately 60° C.)) as the cyclic olefin copolymer in 95 parts by mass of liquid paraffin ("Moresco White P-200" manufactured by Matsumura Oil Research Corporation) as the carrier fluid. Meanwhile, a pigment dispersing element was prepared mixing and dispersing 72 parts by mass of liquid paraffin ("Moresco White P-200" manufactured by Moresco) as the carrier fluid, 20 parts by mass of a cyan pigment (C.I. Pigment Blue 15:3) as the colored particles, and 8 parts by mass of "Antaron (registered trademark) V-216" manufactured by ISP as the dispersion stabilizer using a rocking mill ("RM-10" manufactured by Seiwa Giken Co., Ltd.) at a drive frequency of 60 Hz for 1 hour. The average particle diameter ($D_{50}$) of the pigment in the pigment dispersing element was 0.5 μm. Subsequently, by mixing the resin solution and the pigment dispersing element at a mixture ratio (mass ratio) of 3:1, as shown in Table 3, a cyan liquid developer A containing 5 mass percent of the pigment and 3.75 mass percent of the cyclic olefin copolymer was manufactured.

(Manufacture of Liquid Developer B)

As shown in Table 3, a cyan liquid developer B containing 5 mass percent of the pigment and 1 mass percent of the cyclic olefin copolymer was obtained as with the liquid developer A other than setting the content of the cyclic olefin copolymer in the resin solution to 1.34 parts by mass and setting the content of the carrier fluid to 98.66 parts by mass.

(Manufacture of Liquid Developer C)

As shown in Table 3, a cyan liquid developer C containing 5 mass percent of the pigment and 2 mass percent of the cyclic olefin copolymer was obtained as with the liquid developer A other than setting the content of the cyclic olefin copolymer in the resin solution to 2.67 parts by mass and setting the content of the carrier fluid to 97.33 parts by mass.

(Manufacture of Liquid Developer D)

As shown in Table 3, a cyan liquid developer D containing 5 mass percent of the pigment and 8 mass percent of the cyclic olefin copolymer was obtained as with the liquid developer A other than setting the content of the cyclic olefin copolymer in the resin solution to 10.67 parts by mass and setting the content of the carrier fluid to 89.33 parts by mass.

(Manufacture of Liquid Developer E)

As shown in Table 3, a cyan liquid developer E containing 5 mass percent of the pigment and 9 mass percent of the cyclic olefin copolymer was obtained as with the liquid developer A other than setting the content of the cyclic olefin copolymer in the resin solution to 12 parts by mass and setting the content of the carrier fluid to 88 parts by mass.

(Manufacture of Liquid Developer F)

As shown in Table 3, a cyan liquid developer F containing 5 mass percent of the pigment but not containing the cyclic olefin copolymer was manufactured mixing and dispersing 93 parts by mass of liquid paraffin ("Moresco White P-200" manufactured by Moresco) as the carrier fluid, 5 parts by mass of a cyan pigment (C.I. Pigment Blue 15:3) as the colored particles, and 2 parts by mass of "Antaron (registered trademark) V-216" manufactured by ISP as the dispersion stabilizer.

(Formation of Image)

Using the wet-type image forming apparatus (color printer) 1A (an experimental apparatus of the wet-type image forming apparatus manufactured by Kyocera Mita Corporation) shown in FIG. 1 that does not include the fixing part, the cyan liquid developers A to F were placed inside the cyan image forming unit FC, a square solid image (5 cm×5 cm) filled uniformly with a pigment application amount correspond to 0.026 mg/cm$^2$ was formed on quality plain paper (C2 paper manufactured by Oji Paper Co., Ltd.: 90 g/m$^2$) as the sheet. Here, the thickness of the liquid developer layer on the circumferential surface of the developing roller 141 was set to 5 μm. Moreover, the development field to be applied to the developing roller 141 upon forming the image on the surface of the photoconductor drum 10 based on the image data was set to 400 V. Subsequently, the sheet ejected from the ejection part 6 was subject to the following fixability test.

(Fixability Test)

A scratch resistance test was performed in order to evaluate the fixability of the image portion of the sheet ejected from the ejection part 6 to which a solid image was transferred by the secondary transfer part 4. Specifically, a metal columnar weight (diameter of 50 mm with cloth (padding) placed at the bottom face thereof) with a mass of 300 g was placed on the image portion 5 seconds after such image was formed with the secondary transfer part 4, and the weight was moved laterally across the image so that it goes outside the image, and the same movement across the same path was repeated 10 times. In order to observe whether the image was rubbed and scratched with the mass of the weight, the image density of the portion outside the solid image and which is the portion where the weight moved was measured as circumferential image density with a spectrophotometer ("X-rite Spectro Eye" manufactured by Gretag Macbeth). The evaluation standard of the fixability was as follows; namely, "O" was indicated for those with a circumferential image density of less than 0.01, "Δ," was indicated for those with a circumferential image density of 0.01 or more and less than 0.05, and "×" was indicated for those with a circumferential image density of 0.05 or more. Note that this test also doubles as a test of the drying property of the coated layer of the cyclic olefin copolymer.

The results are shown in Table 3.

(Results and Consideration)

As evident from Table 3, the liquid developers A to E containing cyclic olefin copolymer had superior fixability in comparison to the liquid developer F that does not contain cyclic olefin copolymer in a liquid developer in which the pigments are dispersed in the carrier fluid.

Among the liquid developers A to E, the liquid developers A, C and D in which the content of the cyclic olefin copolymer is 2 to 8 mass percent particularly had superior fixability.

As explained above in detail with specific examples, since the liquid developer according to this embodiment contains an electrically insulating carrier fluid and colored particles dispersed in the carrier fluid and the colored particles are pigments and the liquid developer contains cyclic olefin copolymer, the cyclic olefin copolymer coats the pigments remaining on the surface of the recording medium and forms a coated layer by remaining on the surface of the recording medium when the carrier fluid is absorbed within the recording medium after the image is transferred to the recording medium, and the pigments are fixed to the recording medium with the coated layer of the cyclic olefin copolymer. It is thereby possible to fix the pigments; that is, the image, to the recording medium with non-heating or at low temperature without consuming considerable thermal energy or light energy, and reduce the consumption energy in the wet-type image forming apparatus. Moreover, it is possible to eliminate or simplify the conventional fixing part (fixing device) itself which consumes considerable thermal or light energy, and thereby achieve the simplification and cost reduction of the wet-type image forming apparatus. In addition, since the colored particles will not fall off from the recording medium and the image is not smeared, it is possible to obtain a high quality image.

When the cyclic olefin copolymer is a copolymer of norbornene and ethylene, a liquid developer with superior fixability can be obtained reliably without consuming thermal energy or light energy.

When the content of the cyclic olefin copolymer in the liquid developer is 2 to 8 mass percent, the favorable drying property of the coated layer and the scratch resistance of the image can be ensured while maintaining superior fixability without consuming considerable thermal energy and light energy.

A wet-type image forming apparatus comprising a charging device for charging a surface of a photoconductor drum, an exposure device for forming an electrostatic latent image on the surface of the charged photoconductor drum, a liquid developing device for developing an electrostatic latent image on the surface of the photoconductor drum with a liquid developer, and a transfer device for transferring the developed image to a recording medium, and in which the wet-type image forming apparatus uses the foregoing liquid

TABLE 3

| | CONTENT (MASS PERCENT) | | | | PIGMENT AVERAGE | FIXABILITY | | |
|---|---|---|---|---|---|---|---|---|
| LIQUID DEVELOPER | CARRIER FLUID | PIGMENT | DISPERSION STABILIZER | CYCLIC OLEFIN COPOLYMER | PARTICLE DIAMETER ($D_{50}$: μm) | CIRCUMFERENTIAL IMAGE DENSITY | EVALUATION | SCOPE OF PRESENT INVENTION |
| A | 89.25 | 5 | 2 | 3.75 | 0.5 | 0.004 | ○ | ○ |
| B | 92 | 5 | 2 | 1 | 0.5 | 0.046 | Δ | ○ |
| C | 91 | 5 | 2 | 2 | 0.5 | 0.008 | ○ | ○ |
| D | 85 | 5 | 2 | 8 | 0.5 | 0.006 | ○ | ○ |
| E | 84 | 5 | 2 | 9 | 0.5 | 0.040 | Δ | ○ |
| F | 93 | 5 | 2 | 0 | 0.5 | 0.552 | x | |

developer as the liquid developer is a favorable wet-type image forming apparatus from the perspective of energy conservation since the apparatus does not consume considerable thermal or light energy upon performing the fixing process of fixing the transferred image to the recording medium.

Fourth Embodiment

The liquid developer according to this embodiment is a liquid developer containing an electrically insulating carrier fluid and colored particles dispersed in the carrier fluid, wherein the liquid developer contains cellulose ether, and wherein the colored particles are pigments. Since the cellulose ether coats the pigments remaining on the surface of the recording medium and forms a coated layer by remaining on the surface of the recording medium when the carrier fluid is absorbed within the recording medium after the image is transferred to the recording medium, the pigments are fixed to the recording medium with the coated layer of the cellulose ether. It is thereby possible to fix the pigments; that is, the image, to the recording medium without consuming considerable thermal energy or light energy, and reduce the consumption energy in the wet-type image forming apparatus.

<Liquid Developing Device and Wet-Type Image Forming Apparatus>

Since the liquid developing device and the wet-type image forming apparatus according to this embodiment are the same as the first embodiment other than that, as the liquid developer, a liquid developer containing cellulose ether is used in substitute for the liquid developer containing styrene elastomer, the explanation thereof is omitted.

<Wet-Type Image Forming Method>

The wet-type image forming method according to this embodiment is achieved by using the wet-type image forming apparatus 1A and forming an image on a sheet. Specifically, the wet-type image forming method according to this embodiment includes a charging process of charging the surface of the photoconductor drum 10, an exposure process of forming an electrostatic latent image on the surface of the charged photoconductor drum 10, a development process of forming an image by developing the electrostatic latent image on the surface of the photoconductor drum 10 with a liquid developer containing an electrically insulating carrier fluid and colored particles dispersed in the carrier fluid in which the colored particles are pigments and the liquid developer contains cellulose ether, a transfer process of transferring the developed image onto a sheet, and an ejecting process of ejecting the image-transferred sheet from the ejection part 6. The wet-type image forming method according to this embodiment is a favorable wet-type image forming method from the perspective of energy conservation capable of fixing the transferred image to the sheet, without having to consume considerable thermal or light energy upon performing the fixing process of fixing the transferred image to the sheet, by using the liquid developer explained below.

<Liquid Developer>

The liquid developer according to this embodiment contains, as its basic configuration, an electrically insulating carrier fluid and colored particles dispersed in the carrier fluid. The liquid developer contains cellulose ether. The colored particles are pigments. The cellulose ether is preferably ethyl cellulose. The content of the cellulose ether in the liquid developer is preferably 1 to 6 mass percent. Tall oil fatty acid is preferably contained as the carrier fluid. The content of the tall oil fatty acid in the overall carrier fluid is preferably 20 to 90 mass percent.

[Carrier Fluid]

Generally speaking, an electrically insulating carrier fluid functions as a liquid carrier, and is used for increasing the electrical insulation of the obtained liquid developer. As the electrically insulating carrier fluid, an organic solvent possessing electrical insulation and, for instance, having a volume resistance of $10^{10}$ Ω·cm or more (in other words, electrical conductivity of 100 pS/cm or less) at 25° C. is preferably used. As this kind of electrically insulating organic solvent, there is aliphatic hydrocarbon that is a liquid at normal temperature, and, for example, liquid n-paraffinic hydrocarbon, liquid iso-paraffinic hydrocarbon or the mixture thereof, liquid halogenated aliphatic hydrocarbon and the like are preferably used. Specifically, n-hexane, n-heptane, n-octane, nonane, decane, dodecane, hexadecane, hepladecane, cyclohexane, perchloroethylene, trichloroethane and the like may be used. Moreover, aliphatic hydrocarbon with a branched-chain is particularly favorable. From the perspective of VOC (volatile organic compounds), a carrier fluid with relatively low volatility (for example, with a boiling point of 200° C. or higher) is preferably used, and, for example, liquid paraffin and the like containing relatively large amounts of aliphatic hydrocarbon with a carbon number of 16 or higher are preferably used.

Commercially available carrier fluids may be used, and, for example, "Isopar G," "Isopar H," "Isopar K," "Isopar L," "Isopar M," "Isopar V" manufactured by Exxon Mobile can be preferably used. Moreover, liquid paraffin "Moresco White P-40," "Moresco White P-70," "Moresco White P-200" manufactured by Moresco (the former Matsumura Oil Research Corporation) can also be preferably used. Moreover, liquid paraffin "Cosmo White P-60," "Cosmo White P-70," "Cosmo White P-120" manufactured by Cosmo Oil, Ltd. can also be preferably used.

As the carrier fluid that can be used in this embodiment, in addition to the foregoing physical properties, a carrier fluid capable of dissolving cellulose ether (solubility of cellulose ether is relatively high) is preferably used. As this kind of carrier fluid, for example, oils such as vegetable oil, animal oil, mineral oil and the like may be used, and, among the above, vegetable oil is preferably used, and, among the vegetable oils, tall oil fatty acid (main component: oleic acid, linoleic acid) is preferably used.

In this embodiment, so as long as the cellulose ether dissolves in the carrier fluid, a carrier fluid in which the solubility of cellulose ether is relatively high (good solvent of cellulose ether) may be used independently, or a carrier fluid in which the solubility of cellulose ether is relatively high and a carrier fluid in which the solubility of cellulose ether is relatively low (poor solvent of cellulose ether) may be mixed and used. Here, it is necessary to pay attention so that, depending on the type of carrier fluid that is used, the electrical conductivity of the overall carrier fluid and consequently the electrical conductivity of the liquid developer may not become excessively high. For example, vegetable oil, animal oil and mineral oil, in addition to tall oil fatty acid, generally have high conductivity in comparison to aliphatic hydrocarbon such as liquid paraffin and the like. Accordingly, it is necessary to pay attention to the content upon including the foregoing oil as the carrier fluid in order to favorably dissolve the cellulose ether in the carrier fluid.

The greater the content of the oil in the overall carrier fluid, it is advantageous in terms of solubility of the cellulose ether but disadvantageous in terms of conductivity. Meanwhile, the lesser the content of the oil in the overall carrier fluid, it is advantageous in terms of conductivity but disadvantageous in terms of solubility of the cellulose ether. Although the content of the oil in the overall carrier fluid depends on the type and content of the cellulose ether in the liquid developer, for example, the content of the oil is preferably 20 to 90 mass percent, more preferably 30 mass percent or more and/or 80 mass percent or less, still more preferably 40 mass percent or more and/or 70 mass percent or less. When the content of the oil is less than 20 mass percent, it becomes difficult to favorably dissolve the cellulose ether in the carrier fluid. When the content of the oil exceeds 90 mass percent, the conductivity of the overall carrier fluid and consequently the conductivity of the liquid developer becomes excessively high. When the conductivity of the liquid developer becomes excessively high, the development performance may be insufficient and the image density may decrease, and more fogging may occur.

In this embodiment, the conductivity of the liquid developer is, for example, preferably 200 pS/cm or less. Accordingly, aliphatic hydrocarbon of high electrical resistance (low conductivity) is preferably mixed with a solution (hereinafter referred to as a "resin solution" in the fourth embodiment) obtained by dissolving cellulose ether in the oil such as tall oil fatty acid in order to control the conductivity of the overall carrier fluid and consequently the conductivity of the liquid developer to be, for example, 200 pS/cm or less.

[Colored Particles]

The explanation is omitted since they are the same as the first embodiment.

[Dispersion Stabilizer]

The explanation is omitted since it is the same as the first embodiment.

[Cellulose Ether]

The liquid developer according to this'embodiment contains cellulose ether. Cellulose ether is a macromolecule in which the hydroxyl group in the cellulose molecule is substituted with an alkoxy group. The substitution rate is preferably 45 to 49.5%. Moreover, the alkyl portion of the alkoxy group may also be substituted, for example, with a hydroxyl group or the like. The coated layer formed with the cellulose ether yields superior toughness, thermal stability and so on.

As the cellulose ether that can be used in this embodiment, on the condition that the cellulose ether can stably exist for a long period of time in a dissolved state in the carrier fluid, and that the cellulose ether can form a coated layer by remaining on the surface of the sheet (recording medium) when the concentration of the cellulose ether in the carrier fluid on the surface of the sheet increases and exceeds the saturated solubility after the image is transferred to the sheet, for example, alkyl cellulose such as methyl cellulose and ethyl cellulose; hydroxyalkyl cellulose such as hydroxyethyl cellulose and hydroxypropyl cellulose; hydroxyalkylalkyl cellulose such as hydroxyethylmethyl cellulose, hydroxypropylmethyl cellulose, and hydroxyethylethyl cellulose; carboxyalkyl cellulose such as carboxymethyl cellulose; and carboxyalkylhydroxyalkyl cellulose such as carboxymethylhydroxyethyl cellulose may be used. These may be used independently or as a combination of two or more types depending on the circumstances. Among the above, alkyl cellulose is preferably used and, among the alkyl celluloses, ethyl cellulose is preferably used from the perspective that it is possible to reliably obtain a liquid developer with superior fixability without consuming thermal energy or light energy.

In the liquid developer according to this embodiment, the cellulose ether exists in a state of being dissolved in the carrier fluid. Consequently, the mechanism of fixing the image to the sheet is basically as follows. Specifically, the cellulose ether in the liquid developer stored in the developing vessel 140 of the liquid developing device 14 exists in a state of being dissolved in the carrier fluid. This state is the same on the developing roller 141, on the photoconductor drum 10, and on the intermediate transfer belt 21. Needless to say, although the ratio of the carrier fluid in the liquid developer will gradually decrease, the cellulose ether in the liquid developer is still in the state of being dissolved in the carrier fluid. Subsequently, when the image is transferred from the intermediate transfer belt 21 to the sheet by the secondary transfer part 4, the cellulose ether and the colored particles (pigments) in the carrier fluid remain on the surface of the sheet, and the carrier fluid is absorbed within the sheet. Pursuant thereto, the concentration of the cellulose ether in the carrier fluid on the surface of the sheet will increase, and exceeds the saturated solubility. The cellulose ether that exceeds the saturated solubility coats the pigments remaining on the surface of the sheet and forms a coated layer by remaining on the surface of the sheet. Since the pigments are fixed to the sheet with the coated layer of the cellulose ether, it is possible to fix the pigments; that is, the image that has been transferred to the sheet, to the sheet without consuming considerable thermal energy or light energy, and reduce the consumption energy in the wet-type image forming apparatus. This is extremely effective from the perspective of environmental protection. Moreover, since the wet-type image forming apparatus 1A according to this embodiment no longer needs the conventional fixing part 5 which uses thermal or light energy, it is possible to seek the simplification and cost reduction of the wet-type image forming apparatus 1A.

Note that a state where the cellulose ether is dissolved in the carrier fluid also includes a gelled state. Depending on the type and molecular weight of the cellulose ether, the cellulose ethers could mutually entwine in the carrier fluid and become a gelled state with relatively low fluidity. For example, when the concentration of the cellulose ether is high or when the affinity of the cellulose ether and the solvent is low, or when the temperature is low, the cellulose ether often becomes a gelled state. Meanwhile, when the cellulose ethers hardly become mutually entwined in the carrier fluid and the fluidity is relatively high, the cellulose ether may be in a liquid state.

A commercially available cellulose ether can be used in this embodiment. For example, as the ethyl cellulose, "Ethocel (registered trademark) STD4," "Ethocel (registered trademark) STD7," "Ethocel (registered trademark) STD10" manufactured by The Dow Chemical Company can be used. These may be used independently or as a combination of two or more types depending on the circumstances.

The content of the cellulose ether in the liquid developer is preferably 1 to 6 mass percent, more preferably 2 mass percent or more and/or 5 mass percent or less, still more preferably 3 mass percent or more and/or 4 mass percent or less. When the content of the cellulose ether is less than 1 mass percent, the amount of the cellulose ether coated layer remaining on the surface of the sheet may become too small, and the film formation properties and consequently the fixability may become considerably insufficient. When the content of the cellulose ether exceeds 6 mass percent, the amount of the cellulose ether coated layer remaining on the surface of the sheet may become too great, and the drying property of the coated layer may deteriorate excessively, the viscosity (tack properties) of the coated layer may increase excessively, the rubber elasticity of the coated layer may increase excessively, and the scratch resistance of the image may deteriorate excessively. Moreover, the development performance may be insufficient and the image density may decrease, and more fogging may occur.

[Manufacturing Method]

Since the manufacturing method is the same as the third embodiment other than using cellulose ether in substitute for the cyclic olefin copolymer, the explanation thereof is omitted.

Examples

The present invention is now explained in further detail with reference to the Examples and Comparative Examples, but the present invention shall not be limited by the following Examples.

(Manufacture of Liquid Developer A)

A resin solution was prepared by dissolving 5.1 parts by mass of ethyl cellulose ("Ethocel (registered trademark) STD4" (ethoxylation rate: 45 to 49.5%) manufactured by The Dow Chemical Company) as the cellulose ether in 95.2 parts by mass of tall oil fatty acid ("Hartall FA-1" manufactured by Harima Chemicals, Inc.) as the carrier fluid. Meanwhile, a pigment dispersing element was prepared mixing and dispersing 71.2 parts by mass of liquid paraffin ("Moresco White P-200" manufactured by Moresco) as the carrier fluid, 20 parts by mass of a cyan pigment (C.I. Pigment Blue 15:3) as the colored particles, and 8 parts by mass of "Antaron (registered trademark) V-216" manufactured by ISP as the dispersion stabilizer using a rocking mill ("RM-10" manufactured by Seiwa Giken Co., Ltd.) at a drive frequency of 60 Hz for 1 hour. The average particle diameter ($D_{50}$) of the pigment in the pigment dispersing element was 0.5 μm. Subsequently, by mixing the resin solution and the pigment dispersing element at a mixture ratio (mass ratio) of 3:1, as shown in Table 4, a cyan liquid developer A containing 5 mass percent of the pigment and 3.8 mass percent of the ethyl cellulose, and in which the content, of the tall oil fatty acid in the overall carrier fluid is 80 mass percent, was manufactured.

(Manufacture of Liquid Developer B)

As shown in Table 4, a cyan liquid developer B containing 5 mass percent of the pigment and 1.0 mass percent of the ethyl cellulose, and in which the content of the tall oil fatty acid in the overall carrier fluid is 80 mass percent, was obtained as with the liquid developer A other than setting the content of the ethyl cellulose in the resin solution to 1.33 parts by mass, setting the content of the tall oil fatty acid in the resin solution to 98.1 parts by mass and setting the content of the liquid paraffin in the pigment dispersing element to 73.6 parts by mass.

(Manufacture of Liquid Developer C)

As shown in Table 4, a cyan liquid developer C containing 5 mass percent of the pigment and 6.0 mass percent of the ethyl cellulose, and in which the content of the tall oil fatty acid in the overall carrier fluid is 80 mass percent, was obtained as with the liquid developer A other than setting the content of the ethyl cellulose in the resin solution to 8 parts by mass, setting the content of the tall oil fatty acid in the resin solution to 92.8 parts by mass and setting the content of the liquid paraffin in the pigment dispersing element to 69.6 parts by mass.

(Manufacture of Liquid Developer D)

As shown in Table 4, a cyan liquid developer D containing 5 mass percent of the pigment and 3.8 mass percent of the ethyl cellulose, and in which the content of the tall oil fatty acid in the overall carrier fluid is 90 mass percent, was obtained as with the liquid developer A other than setting the content of the tall oil fatty acid in the resin solution to 107.2 parts by mass and setting the content of the liquid paraffin in the pigment dispersing element to 35.2 parts by mass.

(Manufacture of Liquid Developer E)

As shown in Table 4, a cyan liquid developer E containing 5 mass percent of the pigment and 1.0 mass percent of the ethyl cellulose, and in which the content of the tall oil fatty acid in the overall carrier fluid is 20 mass percent, was obtained as with the liquid developer A other than setting the content of the ethyl cellulose in the resin solution to 1.33 parts by mass, setting the content of the tall oil fatty acid in the resin solution to 24.5 parts by mass and setting the content of the liquid paraffin in the pigment dispersing element to 294.4 parts by mass.

(Manufacture of Liquid Developer F)

As shown in Table 4, a cyan liquid developer F containing 5 mass percent of the pigment and 0.5 mass percent of the cyclic olefin copolymer, and in which the content of the tall oil fatty acid in the overall carrier fluid is 80 mass percent, was obtained as with the liquid developer A other than setting the content of the ethyl cellulose in the resin solution to 0.67 parts by mass, setting the content of the tall oil fatty acid in the resin solution to 98.7 parts by mass and setting the content of the liquid paraffin in the pigment dispersing element to 74 parts by mass.

(Manufacture of Liquid Developer G)

As shown in Table 4, a cyan liquid developer G containing 5 mass percent of the pigment and 7.0 mass percent of the ethyl cellulose, and in which the content of the tall oil fatty acid in the overall carrier fluid is 80 mass percent, was obtained as with the liquid developer A other than setting the content of the ethyl cellulose in the resin solution to 9.3 parts by mass, setting the content of the tall oil fatty acid in the resin solution to 91.7 parts by mass and setting the content of the liquid paraffin in the pigment dispersing element to 68.8 parts by mass.

(Manufacture of Liquid Developer H)

As shown in Table 4, a cyan liquid developer H containing 5 mass percent of the pigment and 3.8 mass percent of the ethyl cellulose, and in which the content of the tall oil fatty acid in the overall carrier fluid is 95 mass percent, was obtained as with the liquid developer A other than setting the content of the tall oil fatty acid in the resin solution to 113.1 parts by mass and setting the content of the liquid paraffin in the pigment dispersing element to 17.6 parts by mass.

(Manufacture of Liquid Developer I)

As shown in Table 4, a cyan liquid developer I containing 5 mass percent of the pigment and 1.0 mass percent of the ethyl cellulose, and in which the content of the tall oil fatty acid in the overall carrier fluid is 15 mass percent, was obtained as with the liquid developer A other than setting the content of the ethyl cellulose in the resin solution to 1.33 parts by mass, setting the content of the tall oil fatty acid in the resin solution to 18.4 parts by mass and setting the content of the liquid paraffin in the pigment dispersing element to 312.8 parts by mass.

(Manufacture of Liquid Developer J)

As shown in Table 4, a cyan liquid developer J containing mass percent of the pigment but not containing the ethyl cellulose, and in which the content of the tall oil fatty acid in the overall carrier fluid is 80 mass percent, was manufactured mixing and dispersing 18.6 parts by mass of liquid paraffin ("Moresco White P-200" manufactured by Moresco) as the carrier fluid, 5 parts by mass of a cyan pigment (C.I. Pigment Blue 15:3) as the colored particles, and 2 parts by mass of "Antaron (registered trademark) V-216" manufactured by ISP as the dispersion stabilizer using a rocking mill ("RM-10" manufactured by Seiwa Giken Co., Ltd.) at a drive frequency of 60 Hz for 1 hour, and additionally mixing 74.4 parts by mass of tall oil fatty acid ("Hartall FA-1" manufactured by Harima Chemicals, Inc.) as the carrier fluid.

TABLE 4

| LIQUID DEVELOPER | CONTENT (MASS PERCENT) CARRIER FLUID TALL OIL FATTY ACID | LIQUID PARAFFIN | PIGMENT | DISPERSION STABILIZER | ETHYL CELLULOSE | PIGMENT AVERAGE PARTICLE DIAMETER ($D_{50}$: μm) | SCOPE OF PRESENT INVENTION |
|---|---|---|---|---|---|---|---|
| A | 71.4 (80%) | 17.8 | 5 | 2 | 3.8 | 0.5 | ○ |
| B | 73.6 (80%) | 18.4 | 5 | 2 | 1.0 | 0.5 | ○ |
| C | 69.6 (80%) | 17.4 | 5 | 2 | 6.0 | 0.5 | ○ |
| D | 80.4 (90%) | 8.8 | 5 | 2 | 3.8 | 0.5 | ○ |
| E | 18.4 (20%) | 73.6 | 5 | 2 | 1.0 | 0.5 | ○ |
| F | 74.0 (80%) | 18.5 | 5 | 2 | 0.5 | 0.5 | ○ |
| G | 68.8 (80%) | 17.2 | 5 | 2 | 7.0 | 0.5 | ○ |
| H | 84.8 (95%) | 4.4 | 5 | 2 | 3.8 | 0.5 | ○ |
| I | 13.8 (15%) | 78.2 | 5 | 2 | 1.0 | 0.5 | ○ |
| J | 74.4 (80%) | 18.6 | 5 | 2 | 0 | 0.5 | |

The numerical figure in ( ) is the content (mass percent) of the tall oil fatty acid in the overall carrier fluid.

(Measurement of Conductivity)

The conductivity of the liquid developers A to J was measured using the super insulation tester "SM-8220" manufactured by Hioki E.E. Corporation and the liquid sample electrode "SME-8330" (electrode constant: 500) manufactured by Hioki E.E. Corporation. Specifically, 25 mL of the liquid developer was placed in the liquid sample electrode, and, under an environment of 25° C., the electrical resistance (Ω) of the liquid developer was measured under the conditions of an application voltage of 100V and application time of 180 seconds, and the conductivity was calculated based on the following Formula (1) from the obtained electrical resistance:

$$\text{Conductivity(pS/cm)}=1/\{(\text{electrical resistance}(\Omega)\times\text{electrode constant(cm)})\times10^{12}\} \quad (1).$$

(Formation of Image)

Using the wet-type image forming apparatus (color printer) 1A (an experimental apparatus of the wet-type image forming apparatus manufactured by Kyocera Mita Corporation, linear velocity: 116 mm/s) shown in FIG. 1 that does not include the fixing part, the cyan liquid developers A to J were placed inside the cyan image forming unit FC, a square solid image (5 cm×5 cm) filled uniformly with a pigment application amount correspond to 0.026 mg/cm$^2$ was formed on printing paper (wet development paper "EP-L" manufactured by Mitsubishi Paper Mills Limited: 128 g/m$^2$) as the sheet. Here, the thickness of the liquid developer layer on the circumferential surface of the developing roller 141 was set to 5 μm. Moreover, the development field to be applied to the developing roller 141 upon forming the image on the surface of the photoconductor drum 10 based on the image data was set to 400 V. Subsequently, the sheet ejected from the ejection part 6 was subject to the fixability evaluation and image evaluation. The other image forming conditions are shown below.

Bias potential of the developing corona charge with the developing roller charging device 147: 4000 V Intermediate transfer belt 21: Made of polyimide with conductivity Dark potential of the photoconductor drum 10: +550 V Light potential of the photoconductor drum 10: +10 V Primary transfer voltage of the primary transfer roller 20: 300 V (constant voltage control)

Secondary transfer current of the secondary transfer part 4: 40 μA (constant current control)

(Fixability Evaluation)

A scratch resistance test was performed in order to evaluate the fixability of the image portion of the sheet ejected from the ejection part 6 to which a solid image was transferred by the secondary transfer part 4. Specifically, a metal columnar weight (diameter of 50 mm with cloth (padding) placed at the bottom face thereof) with a mass of 300 g was placed on the image portion 5 seconds after such image was formed with the secondary transfer part 4, and the weight was moved laterally across the image so that it goes outside the image, and the same movement across the same path was repeated 10 times. In order to observe whether the image was rubbed and scratched with the mass of the weight, the image density of the portion outside the solid image and which is the portion where the weight moved was measured as circumferential image density with a spectrophotometer ("X-rite Spectro Eye" manufactured by Gretag Macbeth). The evaluation standard of the fixability was as follows; namely, "O" was indicated for those with a circumferential image density of less than 0.01, "Δ" was indicated for those with a circumferential image density of 0.01 or more and less than 0.05, and "×" was indicated for those with a circumferential image density of 0.05 or more. Note that this test also doubles as a test of the drying property of the coated layer of the cellulose ether.

(Image Evaluation)

An image density of the solid image was measured using a spectrophotometer ("X-rite Spectro Eye" manufactured by Gretag Macbeth). The evaluation standard of the image density was as follows; namely, "O" was indicated for those with an image density of 1.1 or more, "Δ," was indicated for those with an image density of 0.7 or more and less than 1.1, and "×" was indicated for those with an image density of 0.7 or less. Moreover, the image density of the non-image portion other than the solid image was measured using a spectrophotometer ("X-rite Spectro Eye" manufactured by Gretag Macbeth). More specifically, the value obtained by subtracting the image density of the non-image portion before image formation from the image density of the non-image portion after image formation was calculated as the fogging image density. The evaluation standard of the fogging image density was as follows; namely, "O" was indicated for those with a fogging image density of less than 0.02, "Δ," was indicated for those with a fogging image density of 0.02 or more and less than 0.06, and "×" was indicated for those with a fogging image density of 0.06 or more.

The results are shown in Table 5.

TABLE 5

| LIQUID DEVELOPER | CONDUCTIVITY (pS/cm) | FIXABILITY EVALUATION: CIRCUMFERENTIAL IMAGE DENSITY | FIXABILITY EVALUATION: DETERMINATION | IMAGE EVALUATION: IMAGE DENSITY | IMAGE EVALUATION: DETERMINATION | IMAGE EVALUATION: FOGGING IMAGE DENSITY | IMAGE EVALUATION: DETERMINATION | SCOPE OF PRESENT INVENTION |
|---|---|---|---|---|---|---|---|---|
| A | 0.02 | 0.003 | ○ | 1.25 | ○ | 0.004 | ○ | ○ |
| B | 0.02 | 0.007 | ○ | 1.30 | ○ | 0.004 | ○ | ○ |
| C | 0.02 | 0.001 | ○ | 1.15 | ○ | 0.008 | ○ | ○ |
| D | 0.02 | 0.003 | ○ | 1.13 | ○ | 0.012 | ○ | ○ |
| E | 0.005 | 0.004 | ○ | 1.35 | ○ | 0.008 | ○ | ○ |
| F | 0.02 | 0.018 | Δ | 1.30 | ○ | 0.006 | ○ | ○ |
| G | 0.02 | 0.021 | Δ | 0.93 | Δ | 0.026 | Δ | ○ |
| H | 0.03 | 0.004 | ○ | 0.95 | Δ | 0.030 | Δ | ○ |
| I | <0.005 | 0.016 | Δ | 1.36 | ○ | 0.004 | ○ | ○ |
| J | 0.02 | 0.496 | x | 1.32 | ○ | 0.005 | ○ | |

(Results and Consideration)

As evident from Table 5, the liquid developers A to I containing cellulose ether had superior fixability in comparison to the liquid developer J that does not contain cellulose ether in a liquid developer in which the pigments are dispersed in the carrier fluid.

Among the liquid developers A to I, the liquid developers A to E and H in which the content of the cellulose ether is 1 to 6 mass percent particularly had superior fixability. In the liquid developer I, although the content of the cellulose ether is within the range of 1 to 6 mass percent, since the content rate of the tall oil fatty acid in the overall carrier fluid was excessively low (15 mass percent), the cellulose ether did not favorably dissolve in the carrier fluid, and a part thereof became deposited. Thus, the fixability was slightly inferior in comparison to the liquid developers A to E, H (particularly liquid developers B, E).

Among the liquid developers A to I, the liquid developers A to F in which the content of the tall oil fatty acid in the overall carrier fluid is within the range of 20 to 90 mass percent achieved favorable image evaluation. In the liquid developer G, although the content of the tall oil fatty acid in the overall carrier fluid is within the range of 20 to 90 mass percent, since the content of the cellulose ether was excessively high (7 mass percent), the image evaluation was slightly inferior in comparison to the liquid developers A to F.

As explained above in detail with specific examples, since the liquid developer according to this embodiment contains an electrically insulating carrier fluid and colored particles dispersed in the carrier fluid and the colored particles are pigments and the liquid developer contains cellulose ether, the cellulose ether coats the pigments remaining on the surface of the recording medium and forms a coated layer by remaining on the surface of the recording medium when the carrier fluid is absorbed within the recording medium after the image is transferred to the recording medium, and the pigments are fixed to the recording medium with the coated layer of the cellulose ether. It is thereby possible to fix the pigments; that is, the image, to the recording medium with non-heating or at low temperature without consuming considerable thermal energy or light energy, and reduce the consumption energy in the wet-type image forming apparatus. Moreover, it is possible to eliminate or simplify the conventional fixing part (fixing device) itself which consumes considerable thermal or light energy, and thereby achieve the simplification and cost reduction of the wet-type image forming apparatus. In addition, since the colored particles will not fall off from the recording medium and the image is not smeared, it is possible to obtain a high quality image.

When the cellulose ether is ethyl cellulose, a liquid developer with superior fixability can be obtained reliably without consuming thermal energy or light energy.

When the content of the cellulose ether in the liquid developer is 1 to 6 mass percent, the favorable drying property of the coated layer, scratch resistance of the image and favorable development performance can be ensured while maintaining superior fixability.

When tall oil fatty acid is contained as the carrier fluid, the cellulose ether favorably dissolves in the carrier fluid.

When the content of the tall oil fatty acid in the overall carrier fluid is 20 to 90 mass percent, it is possible to prevent the conductivity of the carrier fluid and consequently the conductivity of the liquid developer from becoming excessively high while maintaining the favorable solubility of the cellulose ether in the carrier fluid.

A wet-type image forming apparatus comprising a charging device for charging a surface of a photoconductor drum, an exposure device for forming an electrostatic latent image on the surface of the charged photoconductor drum, a liquid developing device for developing an electrostatic latent image on the surface of the photoconductor drum with a liquid developer, and a transfer device for transferring the developed image to a recording medium, and in which the wet-type image forming apparatus uses the foregoing liquid developer as the liquid developer is a favorable wet-type image forming apparatus from the perspective of energy conservation since the apparatus does not consume considerable thermal or light energy upon performing the fixing process of fixing the transferred image to the recording medium.

Note that, although styrene elastomer, polyvinyl butyral, cyclic olefin copolymer or cellulose ether was individually contained in the liquid developer of each of the foregoing embodiments, depending on the circumstances, it goes without saying that similar operations and effects can be yielded upon containing a combination of two or more of the above. Specifically, the liquid developer may contain at least one selected from a group consisting of styrene elastomer, polyvinyl butyral, cyclic olefin copolymer and cellulose ether.

Fifth Embodiment

The present inventors discovered that colored particles can be fixed to a recording medium with non-heating or at low temperature without having to perform the fixing process of heating the developer at a high temperature by causing the liquid developer to contain an organic macromolecular compound which dissolves in the carrier fluid and is used for fixing the colored particles, and using the pigments themselves as the colored particles.

<Liquid Developer>

The liquid developer according to this embodiment is a liquid developer containing, as its basic configuration, an electrically insulating carrier fluid and colored particles dispersed in the carrier fluid. The liquid developer further contains an organic macromolecular compound for fixing the colored particles to a recording medium, and the organic macromolecular compound is dissolved in the carrier fluid. The colored particles are pigments. Since the organic macromolecular compound coats the pigments remaining on the surface of the recording medium and forms a coated layer by remaining on the surface of the recording medium when the carrier fluid is absorbed within the recording medium after the image is transferred to the recording medium, the pigments are fixed to the recording medium with the coated layer of the organic macromolecular compound. It is thereby possible to fix the pigments; that is, the image, to the recording medium without consuming considerable thermal energy or light energy with non-heating or at low temperature, and reduce the consumption energy in the wet-type image forming apparatus.

[Carrier Fluid]

Generally speaking, an electrically insulating carrier fluid functions as a liquid carrier, and is used for increasing the electrical insulation of the obtained liquid developer. As the electrically insulating carrier fluid, a carrier fluid capable of dissolving an organic macromolecular compound described later (solubility of the organic macromolecular compound is relatively high) is used.

Moreover, in addition to the foregoing physical properties, for example, an electrical insulation organic solvent having a volume resistance of $10^{12}$ Ω·cm or more (in other words, electrical conductivity of 1.0 pS/cm or less) at 25° C. is preferably used.

As this kind of electrically insulating organic solvent, for example, aliphatic hydrocarbon, vegetable oil and the like in liquid form at room temperature may be used.

As the aliphatic hydrocarbon, for example, liquid n-paraffinic hydrocarbon, liquid iso-paraffinic hydrocarbon, liquid halogenated aliphatic hydrocarbon, liquid aliphatic hydrocarbon with a branched-chain, a mixture thereof and the like are preferably used. More specifically, n-hexane, n-heptane, n-octane, nonane, decane, dodecane, hexadecane, heptadecane, cyclohexane, perchloroethylene, trichloroethane and the like are preferably used. From the perspective of environmental response (VOC measures), a nonvolatile organic solvent, and an organic solvent with relatively low volatility (for example, with a boiling point of 200° C. or higher) are preferably used, and, for example, liquid paraffin and the like containing relatively large amounts of aliphatic hydrocarbon with a carbon number of 16 or higher are preferably used.

Moreover, as specific examples of vegetable oil, for example, tall oil fatty acid (main component: oleic acid, linoleic acid), vegetable oil-derived fatty acid ester, soybean oil, safflower oil, castor oil, linseed oil, wood oil and the like may be used, and, among the above, tall oil fatty acid and the like may be preferably used.

A commercially available carrier fluid may used as the foregoing carrier fluid and, for example, liquid paraffin "Moresco White P-55," "Moresco White P-40," "Moresco White P-70," "Moresco White P-200" manufactured by Moresco (the former Matsumura Oil Research Corporation); tall oil fatty acid "Hartall FA-1," "Hartall FA-1P," "Hartall FA-3" manufactured by Harima Chemicals, Inc.; vegetable oil-based solvent "Vegesol MT," "Vegesol CM," "Vegesol MB," "Vegesol PR," vegetable oil "Wood Oil" manufactured by Kaneda Co., Ltd.; "Isopar G," "Isopar H," "Isopar K," "Isopar L," "Isopar M," "Isopar V" manufactured by Exxon Mobile; liquid paraffin "Cosmo White P-60," "Cosmo White P-70," "Cosmo White P-120" manufactured by Cosmo Oil, Ltd.; vegetable oil "Soybean Oil Sirasimeyu S," "Linseed Oil," "Safflower Oil" manufactured by The Nisshin OilliO Group, Ltd.; and vegetable oil "Castor Oil LAV," "Castor Oil KO" manufactured by Itoh Oil Chemicals Co., Ltd. can be preferably used.

In this embodiment, so as long as the organic macromolecular compound dissolves in the carrier fluid, a carrier fluid in which the solubility of organic macromolecular compound is relatively high (good solvent of organic macromolecular compound) may be used independently, or a carrier fluid in which the solubility of organic macromolecular compound is relatively high and a carrier fluid in which the solubility of organic macromolecular compound is relatively low (poor solvent of organic macromolecular compound) may be mixed and used. Here, it is necessary to pay attention so that, depending on the type of carrier fluid that is used, the electrical conductivity of the overall carrier fluid and consequently the electrical conductivity of the liquid developer may not become excessively high. For example, vegetable oils and the like including tall oil fatty acid generally have high conductivity in comparison to aliphatic hydrocarbon such as liquid paraffin and the like. Accordingly, it is necessary to pay attention to the content upon including the foregoing oil as the carrier fluid in order to favorably dissolve the organic macromolecular compound in the carrier fluid.

The greater the content of the oil in the overall carrier fluid, it is advantageous in terms of solubility of the organic macromolecular compound but disadvantageous in terms of conductivity. Meanwhile, the lesser the content of the oil in the overall carrier fluid, it is advantageous in terms of conductivity but disadvantageous in terms of solubility of the organic macromolecular compound.

In light of the above, although the content of the oil in the overall carrier fluid depends on the type and content of the organic macromolecular compound in the liquid developer, for example, the content of the oil is preferably within the range of 2 to 80 mass percent, and more preferably 5 to 60 mass percent. When the content of the oil is less than 2 mass percent, it becomes difficult to favorably dissolve the organic macromolecular compound in the carrier fluid. When the content of the oil exceeds 80 mass percent, the conductivity of the overall carrier fluid and consequently the conductivity of the liquid developer becomes excessively high. When the conductivity of the liquid developer becomes excessively high, the development performance may be insufficient and the image density may decrease, and more fogging may occur.

In this embodiment, the conductivity of the liquid developer is, for example, preferably 200 pS/cm or less. Accordingly, aliphatic hydrocarbon of high electrical resistance (low conductivity) is preferably mixed with a solution (hereinafter referred to as a "resin solution" in the fifth embodiment) obtained by dissolving organic macromolecular compound in the oil such as tall oil fatty acid in order to control the conductivity of the overall carrier fluid and consequently the conductivity of the liquid developer to be, for example, 200 pS/cm or less.

[Colored Particles]

The explanation is omitted since they are the same as the first embodiment.

[Dispersion Stabilizer]

The explanation is omitted since it is the same as the first embodiment.

[Organic Macromolecular Compound]

The liquid developer according to this embodiment contains an organic macromolecular compound capable of dissolving in the carrier fluid and fixing the colored particles to a recording medium. As this kind of organic macromolecular compound, there is no particular limitation on the condition that the organic macromolecular compound can stably exist for a long period of time in a dissolved state in the carrier fluid, and that the organic macromolecular compound can form a coated layer by remaining on the surface of the sheet when the concentration of the organic macromolecular compound in the carrier fluid on the surface of the sheet increases and exceeds the saturated solubility after the image is transferred to the sheet.

Note that the term "recording medium" refers to any and all recording mediums on which an image can be formed; for instance, quality plain paper, printing paper, copying paper, tracing paper, cardboard, OHP sheet and the like. These recording mediums are sometimes simply referred to as a "sheet" in the ensuing explanation.

As specific examples, cyclic olefin copolymer, styrene elastomer, cellulose ether, polyvinyl butyral and the like can be used. Preferably, superior effects are yielded when cyclic olefin copolymer, styrene elastomer and the like are used. These may be used independently or in combination of two or more types.

Note that, in the liquid developer according to this embodiment, the organic macromolecular compound exists in a state of being dissolved in the carrier fluid. Moreover, a state where the organic macromolecular compound is dissolved in the carrier fluid also includes a gelled state. Depending on the type and molecular weight of the organic macromolecular compound, the organic macromolecular compounds could mutually entwine in the carrier fluid and become a gelled state with relatively low fluidity. For example, when the concentration of the organic macromolecular compound is high or when the affinity of the organic macromolecular compound and the solvent is low, or when the temperature is low, the organic macromolecular compound often becomes a gelled state. Meanwhile, when the organic macromolecular compounds hardly become mutually entwined in the carrier fluid and the fluidity is relatively high, the organic macromolecular compound may be in a liquid state.

In this embodiment since all or most of the organic macromolecular compound needs to be dissolved in the carrier fluid, an organic macromolecular compound that does not dissolve in the carrier fluid cannot be used (or a carrier fluid that is unable to dissolve the organic macromolecular compound cannot be used). When the organic macromolecular compound exists in the carrier fluid as particles, the particles may exist only on the image portion, and are transferred onto the recording medium together with the colored particles and the like. Since a nonvolatile carrier fluid permeates into the recording medium, in the least the colored particles and particles other than the carrier fluid may remain on the recording medium surface. However, when particles of the organic macromolecular compound remain, since the fixing of such particles is insufficient, they may fall off from the recording medium together with the colored particles when the recording medium is scratched, and this may cause the image to become unclear. Nevertheless, in a state where the organic macromolecular compound is sufficiently dissolved in the carrier fluid, when the carrier fluid permeates into the recording medium, the organic macromolecular compound becomes entwined and deposited and coats the colored particles surface, and, therefore, the colored particles are firmly fixed to the recording medium surface, and it is thereby possible to obtain a high quality image.

The content of the organic macromolecular compound in the liquid developer may differ depending on the type of organic macromolecular compound, but is preferably 1 to 10 mass percent, more preferably 2 to 6 mass percent, and even more preferably 3 to 4 mass percent. When the content of the organic macromolecular compound is less than 1 mass percent, the amount of the organic macromolecular compound coated layer remaining on the surface of the sheet may become too small, and the film formation properties and consequently the fixability may become considerably insufficient. Moreover, when the content of the organic macromolecular compound exceeds 10 mass percent, the amount of the organic macromolecular compound coated layer remaining on the surface of the sheet may become too great, and the drying property of the coated layer may deteriorate excessively, the viscosity (tack properties) of the coated layer may increase excessively, the rubber elasticity of the coated layer may increase excessively, and the scratch resistance of the image may deteriorate excessively. Moreover, the development performance may be insufficient and the image density may decrease, and more fogging may occur.

The organic macromolecular compounds that can be used in this embodiment are now respectively explained in detail.

(Cyclic Olefin Copolymer)

Cyclic olefin copolymer has a cyclic olefin skeleton as its main chain, and is an amorphous thermoplastic olefin-based resin that is free from any environmental load substance, and has superior transparency, lightweight properties, low water absorbability and the like. More specifically, in this embodiment, the cyclic olefin copolymer is a macromolecular compound in which its main chain is made of a carbon-carbon bond, and has a cyclic hydrocarbon structure at least in a part of the main chain. This cyclic hydrocarbon structure is introduced by using, as a monomer, a compound (cyclic olefin) with at least one olefinic double bond in the cyclic hydrocarbon structure as represented with norbornene or tetracyclododecene.

As the cyclic olefin copolymer that can be used in this embodiment, on the condition that the cyclic olefin copolymer can stably exist for a long period of time in a dissolved state in the carrier fluid, and that the cyclic olefin copolymer can form a coated layer by remaining on the surface of the sheet when the concentration of the cyclic olefin copolymer in the carrier fluid on the surface of the sheet increases and exceeds the saturated solubility after the image is transferred to the sheet, for example, (1) addition (co)polymer of cyclic olefin or its hydrogen additive, (2) addition copolymer of cyclic olefin and α-olefin or its hydrogen additive, (3) ring-opening (co)polymer of cyclic olefin or its hydrogen additive, and the like may be used.

As specific examples of the cyclic olefin, there are, for example:

(a) cyclopentene, cyclohexene, cyclooctene;

(b) one-ring cyclic olefin such as cyclopentadiene, 1,3-cyclohexadiene;

(c) two-ring cyclic olefin such as bicyclo[2.2.1]hepta-2-en (norbornene), 5-methyl-bicyclo[2.2.1]hepta-2-en, 5,5-dimethyl-bicyclo[2.2.1]hepta-2-en, 5-ethyl-bicyclo[2.2.1]hepta-2-en, 5-butyl-bicyclo[2.2.1]hepta-2-en, 5-ethylidene-bicyclo[2.2.1]hepta-2-en, 5-hexyl-bicyclo[2.2.1]hepta-2-en, 5-octyl-bicyclo[2.2.1]hepta-2-en, 5-octadecyl-bicyclo[2.2.1]hepta-2-en, 5-methylidyne-bicyclo[2.2.1]hepta-2-en, 5-vinyl-bicyclo[2.2.1]hepta-2-en, 5-propenyl-bicyclo[2.2.1]hepta-2-en;

(d) tricyclo[4.3.0.12,5]deca-3,7-diene (dicyclopentadiene), tricyclo[4.3.0.12,5]deca-3-en;

(e) tricyclo[4.4.0.12,5]undeca-3,7-diene or tricyclo[4.4.0.12,5]undeca-3,8-diene or tricyclo[4.4.0.12,5]undeca-3-en as their partial hydrogen additive (or additive of cyclopentadiene and cyclohexene);

(f) three-ring cyclic olefin such as 5-cyclopentyl-bicyclo[2.2.1]hepta-2-en, 5-cyclohexyl-bicyclo[2.2.1]hepta-2-en, 5-cyclohexenylbicyclo[2.2.1]hepta-2-en, 5-phenyl-bicyclo[2.2.1]hepta-2-en;

(g) four-ring cyclic olefin such as tetracyclo[4.4.0.12,5.17,10]dodeca-3-en (tetracyclododecene), 8-methyltetracyclo[4.4.0.12,5.17,10]dodeca-3-en, 8-ethyltetracyclo[4.4.0.12,5.17,10]dodeca-3-en, 8-methylidynetetracyclo[4.4.0.12,5.17,10]dodeca-3-en, 8-ethylidenetetracyclo[4.4.0.12,5.17,10]dodeca-3-en, 8-vinyltetracyclo[4, 4.0.12,5.17,10]dodeca-3-en, 8-propenyl-tetracyclo[4.4.0.12,5.17,10]dodeca-3-en;

(h) 8-cyclopentyl-tetracyclo[4.4.0.12,5.17,10]dodeca-3-en, 8-cyclohexyl-tetracyclo[4.4.0.12,5.17,10]dodeca-3-en, 8-cyclohexenyl-tetracyclo[4.4.0.12,5.17,10]dodeca-3-en, 8-phenyl-cyclopentyl-tetracyclo[4.4.0.12,5.17,10]dodeca-3-en;

(i) tetracyclo[7.4.13,6.01,9.02,7]tetradeca-4,9,11,13-tetraen (1,4-methano-1,4,4a,9a-tetrahydrofluorene), tetracyclo[8.4.14,7.01, 10.03,8]pentadeca-5, 10,12,14-tetraen (1,4-methano-1,4,4a,5,10,10a-hexahydroanthracene);

(j) pentacyclo[6.6.1.13,6.02,7.09,14]-4-hexadecene, pentacyclo[6.5.1.13,6.02,7.09, 13]-4-pentadecene, pentacyclo[7.4.0.02,7.13,6.110,13]-4-pentadecene; heptacyclo[8.7.0.12,9.14,7.111,17.03,8.012,16]-5-eicosen, heptacyclo[8.7.0.12,9.03,8.14,7.012,17.113,16]-14-eicosen; and (k) multi-ring cyclic olefin such as tetramer of cyclopentadiene and the like. These cyclic olefins may be used independently or as a combination of two or more types.

As the α-olefin, an α-olefin with a carbon number of 2 to 20, preferably 2 to 8 is preferably used, and, as specific examples thereof, there are, for example, ethylene, propylene, 1-butene, 1-pentene, 1-hexene, 3-methyl-1-butene, 3-methyl-1-pentene, 3-ethyl-1-pentene, 4-methyl-1-pentene, 4-methyl-1-hexene, 4,4-dimethyl-1-hexene, 4,4-dimethyl-1-pentene, 4-ethyl-1-hexene, 3-ethyl-1-hexene, 1-octene, 1-decene, 1-dodecene, 1-tetradecene, 1-hexadecene, 1-octadecene, 1-eicosen and the like. These α-olefins may be used independently or as a combination of two or more types.

In this embodiment, there is no particular limitation in the polymerization method of the cyclic olefin, the polymerization method of cyclic olefin and α-olefin, and the hydrogenation method of the obtained polymer, and conventionally known methods may be used.

In this embodiment, there is no particular limitation on the structure of the cyclic olefin copolymer, and it may be a chain shape, a branched shape, or a bridge shape, but it is preferably a normal chain shape.

In this embodiment; as the cyclic olefin copolymer, for example, a copolymer of norbornene and ethylene, or a copolymer of tetracyclododecene and ethylene is preferably used, but the copolymer of norbornene and ethylene is more preferable. The content rate of the norbornene in the copolymer in the foregoing case is preferably 60 to 82 mass percent, more preferably 60 to 79 mass percent, even more preferably 60 to 76 mass percent, and most preferably 60 to 65 mass percent. When the norbornene content rate is less than 60 mass percent, the glass-transition temperature of the coated layer of the cyclic olefin copolymer may become too low, and the firm formation properties of the cyclic olefin copolymer coated layer tend to deteriorate. When the norbornene content rate exceeds 82 mass percent, the glass-transition temperature of the coated layer of the cyclic olefin copolymer may become too high, and the fixability of the pigment; that is, the image, with the cyclic olefin copolymer coated layer tends to deteriorate. Moreover, the solubility of the cyclic olefin copolymer in the carrier fluid may become excessively low.

A commercially available cyclic olefin copolymer can be used in this embodiment. For example, as a copolymer of norbornene and ethylene, "TOPAS (registered trademark) TM" (norbornene content rate: approximately 60 mass percent), "TOPAS (registered trademark) TB" (norbornene content rate: approximately 60 mass percent), "TOPAS (registered trademark) 8007" (norbornene content rate: approximately 65 mass percent), "TOPAS (registered trademark) 5013" (norbornene content rate: approximately 76 mass percent), "TOPAS (registered trademark) 6013" (norbornene content rate: approximately 76 mass percent), "TOPAS (registered trademark) 6015" (norbornene content rate: approximately 79 mass percent), "TOPAS (registered trademark) 6017" (norbornene content rate: approximately 82 mass percent) manufactured by Topas Advanced Polymers GmbH may be used. These may be used independently or as a combination of two or more types.

(Styrene Elastomer)

As the styrene elastomer that can be used in this embodiment, there is no particular limitation and conventionally known styrene elastomer may be used on the condition that the styrene elastomer can stably exist for a long period of time in a dissolved state in the carrier fluid, and that the styrene elastomer can form a coated layer by remaining on the surface of the sheet when the concentration of the styrene elastomer in the carrier fluid on the surface of the sheet increases and exceeds the saturated solubility after the image is transferred to the sheet. As a specific example thereof, for instance, a block copolymer made of an aromatic vinyl compound, and an olefin compound or a conjugated diene compound may be used. As the foregoing block copolymer, for example, a block copolymer or the like having a structure represented by Formula 1 when a polymer block made of an aromatic vinyl compound is A and a polymer block made of an olefin compound or a conjugated diene compound is B may be used.

$$[A\text{-}B]_x\text{-}A \qquad \text{(Formula 1)}$$

(In the formula, x represents an integer in which the number average molecular weight is 1,000 to 100,000.)

As the aromatic vinyl compound configuring the block copolymer, for example, styrene, α-methylstyrene, o-methylstyrene, m-methylstyrene, p-methylstyrene, 2,3-dimethylstyrene, 2,4-dimethylstyrene, monochlorostyrene, dichlorostyrene, p-bromostyrene, 2,4,5-tribromostyrene, 2,4,6-tribromostyrene, o-tert-butylstyrene, m-tert-butylstyrene, p-tert-butylstyrene, ethylstyrene, vinylnaphthalene, vinylanthracene and the like may be used.

The polymer block A may be configured from one type among the foregoing aromatic vinyl compounds, or be configured from two or more types. Among the above, a polymer block A configured from styrene and/or α-methylstyrene offers physical properties that are favorable for the liquid developer according to this embodiment.

As the olefin compound configuring the block copolymer, for example, ethylene, propylene, 1-butene, 2-butene, isobutene, 1-pentene, 2-pentene, cyclopentene, 1-hexene, 2-hexene, cyclohexene, 1-heptene, 2-heptene, cycloheptene, 1-octene, 2-octene, cyclooctene, vinylcyclopentene, vinylcyclohexene, vinylcycloheptene, vinylcyclooctene and the like may be used.

As the conjugated diene compound configuring the block copolymer, for example, butadiene, isoprene, chloroprene, 2,3-dimethyl-1,3-butadiene, 1,3-pentadiene, 1,3-hexadiene and the like may be used.

The polymer block B may be configured from one type of either the olefin compound or the conjugated diene compound, or be configured from two or more types. Among the above, a polymer block B configured from butadiene and/or isoprene offers physical properties that are favorable for the liquid developer according to this embodiment.

As specific favorable examples of the block copolymer, for example, polystyrene-polybutadiene-polystyrene triblock copolymer or its hydrogen additive, polystyrene-polyisoprene-polystyrene triblock copolymer or its hydrogen additive, polystyrene-poly (isoprene/butadiene)-polystyrene triblock copolymer or its hydrogen additive, poly (α-methylstyrene)-polybutadiene-poly α-methylstyrene) triblock copolymer or its hydrogen additive, poly (α-methylstyrene)-polyisoprene-poly (α-methylstyrene) triblock copolymer or its hydrogen additive, poly (α-methylstyrene)-poly (isoprene/butadiene)-poly (α-methylstyrene) triblock copolymer or its hydrogen additive, polystyrene-polyisobutene-polystyrene triblock copolymer, poly (α-methylstyrene)-polyisobutene-poly methylstyrene) triblock copolymer, and the like may be used.

Moreover, as the styrene elastomer that can be used in this embodiment, the styrene-butadiene elastomer (SBS) in which the polymer block A and the polymer block B have a structure represented by Formula 2 can be preferably used.

(Formula 2)

POLYMER BLOCK A POLYMER BLOCK B

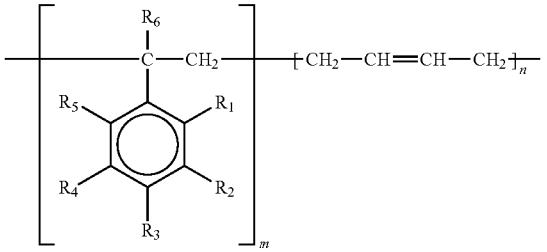

(In the formula, $R_1$, $R_2$, $R_4$, $R_5$, $R_6$ represent hydrogen atoms or a methyl group; $R_3$ represents hydrogen atoms, a saturated alkyl group with a carbon number of 1 to 20, a methoxy group, an ethoxy group, a phenyl group or halogen atoms; and m, n represent an integer in which the content of the polymer block A is 5 to 75 mass percent.)

The styrene-butadiene elastomer can be obtained by copolymerizing styrene monomer, and butadiene as the conjugated diene compound. As a preferred styrene monomer, styrene, α-methylstyrene, o-methylstyrene, m-methylstyrene, p-methylstyrene, p-ethylstyrene, 2,4-dimethylstyrene, p-n-butylstyrene, p-dodecylstyrene, p-methoxystyrene, p-phenylstyrene, p-chlorostyrene and the like may be used.

In the styrene-butadiene elastomer, the number average molecular weight Mn in the molecular weight distribution based on GPC (gel permeation chromatography) is preferably within the range of 1,000 to 100,000 (refer to Formula 1), and more preferably within the range of 2,000 to 50,000. Further, the weight-average molecular weight Mw is preferably within the range of 5,000 to 1,000,000, and more preferably within the range of 10,000 to 500,000. In the foregoing case, preferably, at least one peak exists where the weight-average molecular weight Mw is within the range of 2,000 to 200,000, and preferably within the range of 3,000 to 150,000.

The value of ratio of (weight-average molecular weight Mw/number average molecular weight Mn) of the styrene-butadiene elastomer is preferably 3.0 or less, and more preferably 2.0 or less.

The styrene content (content of polymer block A) in the styrene-butadiene elastomer is preferably within the range of 5 to 75 mass percent (refer to Formula 2, and more preferably within the range of 10 to 65 mass percent. When the styrene content is less than 5 mass percent, the glass-transition temperature of the coated layer of the styrene elastomer may become too low, and the firm formation properties of the styrene elastomer coated layer tend to deteriorate. When the styrene content exceeds 75 mass percent, the softening point of the coated layer of the styrene elastomer may become too high, and the fixability of the pigments; that is, the image, with the styrene elastomer coated layer tends to deteriorate.

A commercially available styrene elastomer can be used in this embodiment. For example, as the styrene-conjugated diene block copolymer, "Kraton" manufactured by Shell; "Asaprene (registered trademark)" T411, T413, T437 and "Tufprene (registered trademark)" A, 315P manufactured by Asahi Kasei Chemicals Corporation; "JSR TR1086," "JSR TR2000," "JSR TR2250," "JSR TR2827" manufactured by JSR; as the hydrogen additive of the styrene-conjugated diene block copolymer, "Dynaron" 6200P, 4600P, 1320P manufactured by JSR; "Septon" S1001, S2063, S4055, S8007 and "Hybrar" 5127, 7311 manufactured by Kuraray; as the styrene-ethylene copolymer, "Index" manufactured by The Dow Chemical Company; and, as the composition, "ARON AR" manufactured by ARONKASEI Co., Ltd., and "Rabalon" manufactured by Mitsubishi Chemical Corporation can be used. These may be independently or as a combination of two or more types depending on the circumstances.

(Cellulose Ether)

Cellulose ether is a macromolecule in which the hydroxyl group in the cellulose molecule is substituted with an alkoxy group. The substitution rate is preferably 45 to 49.5%. Moreover, the alkyl portion of the alkoxy group may also be substituted, for example, with a hydroxyl group or the like. The coated layer formed with the cellulose ether yields superior toughness, thermal stability and so on.

As the cellulose ether that can be used in this embodiment, on the condition that the cellulose ether can stably exist for a long period of time in a dissolved state in the carrier fluid, and that the cellulose ether can form a coated layer by remaining on the surface of the sheet when the concentration of the cellulose ether in the carrier fluid on the surface of the sheet increases and exceeds the saturated solubility after the image is transferred to the sheet, for example, alkyl cellulose such as methyl cellulose and ethyl cellulose; hydroxyalkyl cellulose such as hydroxyethyl cellulose and hydroxypropyl cellulose; hydroxyalkylalkyl cellulose such as hydroxyethylmethyl cellulose, hydroxypropylmethyl cellulose, and hydroxyethylethyl cellulose; carboxyalkyl cellulose such as carboxymethyl cellulose; and carboxyalkylhydroxyalkyl cellulose such as carboxymethylhydroxyethyl cellulose may be used. These may be used independently or as a combination of two or more types depending on the circumstances. Among the above, alkyl cellulose is preferably used and, among the alkyl celluloses, ethyl cellulose is preferably used.

A commercially available cellulose ether can be used in this embodiment. For example, as the ethyl cellulose, "Ethocel (registered trademark) STD4," "Ethocel (registered trademark) STD7," "Ethocel (registered trademark) STD10" manufactured by Nissin-Kasei Co., Ltd. can be used. These may be used independently or in a combination of two or more types depending on the circumstances.

(Polyvinyl Butyral)

Polyvinyl butyral (butyral resin or alkyl acetalized polyvinyl alcohol) that can be used in this embodiment is, as shown in Formula 3, a copolymer of a hydrophilic vinyl alcohol unit having a hydroxyl group, a hydrophobic vinyl acetal unit having a butyral group, and a vinyl acetate unit having an acetyl group with intermediate properties of a vinyl alcohol unit and a vinyl acetal unit. In the liquid developer according to this embodiment, polyvinyl butyral with a degree of butyralization (which defines the ratio of the hydrophilic part and the hydrophobic part) of 60 to 85 mol % is preferable since it yields superior coated layer forming performance (film formation properties). Since polyvinyl butyral includes a vinyl acetal unit showing solubility to the nonpolar solvent, and a vinyl alcohol unit which improves the binding capacity to the recording medium such as paper, polyvinyl butyral yields high affinity to both the carrier fluid and the recording medium.

(Formula 3)

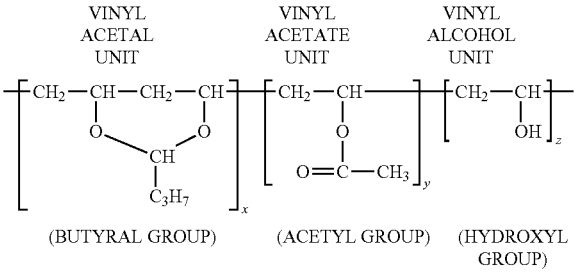

As the polyvinyl butyral that can be used in this embodiment, there is no particular limitation on the condition that the polyvinyl butyral can stably exist for a long period of time in a dissolved state in the carrier fluid, and that the polyvinyl butyral can form a coated layer by remaining on the surface of the sheet when the concentration of the polyvinyl butyral in the carrier fluid on the surface of the sheet increases and exceeds the saturated solubility after the image is transferred to the sheet. For example, "Mowital (registered trademark)" B20H, B30B, B30H, B60T, B60H, B60HH, B70H manufactured by Hoechst AG; "S-rec (registered trademark)" BL-1 (degree of butyralization: 63±3 mol %), BL-2 (degree of butyralization: 63±3 mol %), BL-S (degree of butyralization: 70 mol % or more), BL-L, BH-3 (degree of butyralization: 65±3 mol %), BM-1 (degree of butyralization: 65±3 mol %), BM-2 (degree of butyralization: 68±3 mol %), BM-5 (degree of butyralization: 63±3 mol %), BM-S manufactured by Sekisui Chemical Co., Ltd.; and "Denka Butyral" #2000-L, #3000-1, #3000-2, #3000-3, #3000-4, #3000-K, #4000-1, #5000-A, #6000-C manufactured by Denki Kagaku Kogyo K.K. may be preferably used. These may be used independently or as a combination of two or more types.

[Manufacturing Method]

Since the manufacturing method is the same as the third embodiment other than using organic macromolecular compound in substitute for cyclic olefin copolymer, the explanation thereof is omitted.

<Liquid Developing Device and Wet-Type Image Forming Apparatus>

Since the liquid developing device and the wet-type image forming apparatus according to this embodiment are the same as the first embodiment other than that, as the liquid developer, a liquid developer containing organic macromolecular compound is used in substitute for the liquid developer containing styrene elastomer, the explanation thereof is omitted.

<Wet-Type Image Forming Method>

The wet-type image forming method according to this embodiment is achieved by using the wet-type image forming apparatus 1A and forming an image on a sheet. Specifically, the wet-type image forming method according to this embodiment includes a charging process of charging the surface of the photoconductor drum 10, an exposure process of forming an electrostatic latent image on the surface of the charged photoconductor drum 10, a development process of forming an image by developing the electrostatic latent image on the surface of the photoconductor drum 10 with a liquid developer containing an electrically insulating carrier fluid and colored particles dispersed in the carrier fluid in which the colored particles are pigments and the liquid developer contains an organic macromolecular compound, a transfer process of transferring the developed image onto a sheet, and an ejecting process of ejecting the image-transferred sheet from the ejection part 6. The wet-type image forming method according to this embodiment is a favorable wet-type image forming method from the perspective of energy conservation capable of fixing the transferred image to the sheet, without having to consume considerable thermal or light energy upon performing the fixing process of fixing the transferred image to the sheet (or by a fixing process executed at a temperature considerably lower than temperatures conventionally applied, when the fixing process is employed), by using the liquid developer explained above.

Examples

The present invention is now explained in further detail with reference to the Examples and Comparative Examples, but the present invention shall not be limited by the following Examples.

(Manufacture of Liquid Developers A to E, and G to K)

A high concentration pigment dispersing element was prepared by mixing and dispersing 72 parts by mass of liquid paraffin ("Moresco White P-55" manufactured by Moresco) as the carrier fluid 1, 20 parts by mass of a cyan pigment (C.I. Pigment Blue 15:3) as the colored particles, and 8 parts by mass of "Antaron (registered trademark) V-216" manufactured by ISP as the dispersion stabilizer using a rocking mill ("RM-10" manufactured by Seiwa Giken Co., Ltd.) at a drive frequency of 60 Hz for 1 hour at room temperature (25° C.). Note that the temperature, was not controlled even through heat was generated during the mixture/dispersion process. The average particle diameter ($D_{50}$) of the pigment in the pigment dispersing element was 0.5 μm.

Subsequently, a resin solution was obtained by dissolving parts by mass of the respective organic macromolecular compounds (resins) shown in Table 6 below in 85 parts by mass of the respective resin solution solvents similarly shown in Table 6 below by way of agitation and mixing (room temperature (25° C.); rotating speed: 800 rpm; time: 30 minutes) using an agitation device (Tornado SM-102 manufactured by AS ONE Corporation). Here, a case of using a carrier fluid that is different from the carrier fluid 1 is indicated as a carrier fluid 2 in Table 6. Specifically, in this Example, the carrier fluid 1 and the carrier fluid 2 are respectively the first type of carrier fluid (carrier fluid 1) and the second type of carrier fluid (carrier fluid 2) which are used in the respective developers.

Subsequently, liquid developers A to E (Examples 1 to 5) and liquid developers G to K (Examples 7 to 10 and Comparative Example 1) were obtained by agitating and mixing (room temperature (25° C.); rotating speed: 800 rpm; time: 30 minutes) the obtained resin solution and the high concentration pigment dispersing element and the additional carrier fluid, with the mixture ratios respectively shown in Table 7 below, using an agitation device (Tornado SM-102 manufactured by AS ONE Corporation).

TABLE 6

Mixing ratio of resin and solvent and name of raw material

| | | RESIN | SOLVENT | PRODUCT NAME OF RESIN | KIND OF SOLVENT | PRODUCT NAME OF SOLVENT |
|---|---|---|---|---|---|---|
| EXAMPLE 1 | LIQUID DEVELOPER A | 15.0 | 85.0 | TOPAS TM | CARRIER 1 | MORESCO WHITE P55 |
| EXAMPLE 2 | LIQUID DEVELOPER B | 15.0 | 85.0 | TOPAS TM | CARRIER 1 | MORESCO WHITE P55 |
| EXAMPLE 3 | LIQUID DEVELOPER C | 15.0 | 85.0 | ASAPRENE T413 | CARRIER 2 | VEGESOL CM |
| EXAMPLE 4 | LIQUID DEVELOPER D | 15.0 | 85.0 | ASAPRENE T413 | CARRIER 2 | VEGESOL CM |
| EXAMPLE 5 | LIQUID DEVELOPER E | 15.0 | 85.0 | ETHOCEL 4 | CARRIER 2 | HARTALL FA-1 |
| EXAMPLE 7 | LIQUID DEVELOPER G | 15.0 | 85.0 | TOPAS TM | CARRIER 1 | MORESCO WHITE P55 |
| EXAMPLE 8 | LIQUID DEVELOPER H | 15.0 | 85.0 | TOPAS TM | CARRIER 1 | MORESCO WHITE P55 |
| EXAMPLE 9 | LIQUID DEVELOPER I | 15.0 | 85.0 | ASAPRENE T413 | CARRIER 2 | VEGESOL MT |
| EXAMPLE 10 | LIQUID DEVELOPER J | 15.0 | 85.0 | ASAPRENE T413 | CARRIER 2 | VEGESOL MT |
| COMPARATIVE EXAMPLE 1 | LIQUID DEVELOPER K | — | — | — | — | — |

TABLE 7

Method of preparing developer (high concentration pigment dispersion + resin solution + additional carrier)

| | | COMPOUNDING RATIO (PARTS BY MASS) | | | KIND OF | |
|---|---|---|---|---|---|---|
| | | HIGH CONCENTRATION PIGMENT DISPERSION | RESIN SOLUTION | ADDITIONAL CARRIER | ADDITIONAL CARRIER | PRODUCT NAME OF ADDITIONAL CARRIER |
| EXAMPLE 1 | LIQUID DEVELOPER A | 20.0 | 6.7 | 73.3 | CARRIER 1 | MORESCO WHITE P55 |
| EXAMPLE 2 | LIQUID DEVELOPER B | 25.0 | 66.7 | 8.3 | CARRIER 1 | MORESCO WHITE P55 |
| EXAMPLE 3 | LIQUID DEVELOPER C | 20.0 | 6.7 | 73.3 | CARRIER 1 | MORESCO WHITE P55 |
| EXAMPLE 4 | LIQUID DEVELOPER D | 25.0 | 63.3 | 11.7 | CARRIER 1 | MORESCO WHITE P55 |
| EXAMPLE 5 | LIQUID DEVELOPER E | 25.0 | 21.5 | 53.5 | CARRIER 1 | MORESCO WHITE P55 |
| EXAMPLE 7 | LIQUID DEVELOPER G | 20.0 | 3.3 | 76.7 | CARRIER 1 | MORESCO WHITE P55 |
| EXAMPLE 8 | LIQUID DEVELOPER H | 25.0 | 73.3 | 1.7 | CARRIER 1 | MORESCO WHITE P55 |
| EXAMPLE 9 | LIQUID DEVELOPER I | 20.0 | 3.3 | 76.7 | CARRIER 1 | MORESCO WHITE P55 |
| EXAMPLE 10 | LIQUID DEVELOPER J | 25.0 | 70.0 | 5.0 | CARRIER 1 | MORESCO WHITE P55 |
| COMPARATIVE EXAMPLE 1 | LIQUID DEVELOPER K | 25.0 | 0.0 | 75.0 | CARRIER 2 | MORESCO WHITE P200 |

(Manufacture of Liquid Developer F)

A resin solution was obtained by dissolving 3.8 parts by mass of polyvinyl butyral ("S-rec (registered trademark) BL-S" manufactured by Sekisui Chemical Co., Ltd.) in 36.5 parts by mass of castor oil (refined castor oil "LAV" manufactured by Itoh Oil Chemicals Co., Ltd.) as the carrier fluid 1. A liquid developer F (Example 6) was prepared by mixing and dispersing (at 25° C., but the temperature was not controlled even through heat was generated) 40.3 parts by weight of the resin solution, 54.7 parts by mass of the vegetable oil-based solvent "Vegesol MT" manufactured by Kaneda Co., Ltd. as the carrier fluid 2, and 5 parts by mass of a cyan pigment (C.I. Pigment Blue 15:3) as the colored particles using a rocking mill (RM-10 manufactured by Seiwa Giken Co., Ltd.) at a drive frequency of 60 Hz for 1 hour. Note that the average particle diameter ($D_{50}$) of the pigment in the liquid developer F was 0.4 μm.

(Manufacture of Liquid Developer M)

4.0 mol of polyoxypropylene (2.2)-2,2-bis(4-hydroxyphenyl) propane, 1.0 mol of polyoxyethylene (2.2)-2,2-bis (4-hydroxyphenyl) propane, 4.5 mol of terephthalic acid, 0.5 mol of trimellitic anhydride and 4 g of dibutyl tin oxide were reacted under a nitrogen atmosphere at 230° C. for 8 hours and then dried under a reduced pressure of 8.3 kPa to obtain a polyester resin with a softening point of 120° C.

60 parts by weight of the foregoing polyester resin and 40 parts by weight of a cyan pigment (C.I. Pigment Blue 15:3) were dry-mixed with a Henschel mixer, dissolved and kneaded with a twin screw extruder, and thereafter pulverized with an air flow-type pulverizer and classified with an air classifier to obtain toners with a mean volume diameter of 9.5 μm.

Subsequently, a liquid developer M (Comparative Example 2) was prepared by mixing and dispersing 92.9 parts by mass of liquid paraffin ("Moresco White P-55" manufactured by Moresco) as the carrier fluid 1, 5 parts by mass of the foregoing toners, and 2.1 parts by mass of "Antaron (registered trademark) V-216" manufactured by ISP as the dispersion stabilizer at room temperature using a ball mill (universal ball mill UB32 manufactured by Yamato Scientific Co., Ltd.) at a rotating speed of 100 rpm for 96 hours. The average particle diameter ($D_{50}$) of the toners in the liquid developer was 0.4 μm.

The compounding ratio (mass percent) of the pigment, dispersant, organic macromolecular compound, and carrier fluid in the liquid developers A to M obtained above are summarized in Table 8 below. The carrier fluid 1 and the carrier fluid 2 in Table 8 below correspond to the foregoing carrier fluids 1 and 2 or the carrier fluids 1 and 2 in Table 6 and Table 7.

TABLE 8

| | | COLORED PARTICLES | DISPERSANT | ORGANIC MACROMOLECULAR COMPOUND | CARRIER FLUID 1 | CARRIER FLUID 2 | FIXABILITY EVALUATION CIRCUMFERENTIAL IMAGE DENSITY | FIXABILTY DETERMINATION |
|---|---|---|---|---|---|---|---|---|
| EXAMPLE 1 | LIQUID DEVELOPER A | 4.0 | 1.6 | 1.0 | 93.4 | 0.0 | 0.008 | ○ |
| EXAMPLE 2 | LIQUID DEVELOPER B | 5.0 | 2.0 | 10.0 | 83.0 | 0.0 | 0.004 | ○ |
| EXAMPLE 3 | LIQUID DEVELOPER C | 4.0 | 1.6 | 1.0 | 87.7 | 5.7 | 0.006 | ○ |
| EXAMPLE 4 | LIQUID DEVELOPER D | 5.0 | 2.0 | 9.5 | 29.7 | 53.8 | 0.002 | ○ |
| EXAMPLE 5 | LIQUID DEVELOPER E | 5.0 | 2.0 | 3.2 | 71.5 | 18.3 | 0.003 | ○ |
| EXAMPLE 6 | LIQUID DEVELOPER F | 5.0 | 0.0 | 3.8 | 36.5 | 54.7 | 0.002 | ○ |
| EXAMPLE 7 | LIQUID DEVELOPER G | 4.0 | 1.6 | 0.5 | 93.9 | 0.0 | 0.045 | Δ |
| EXAMPLE 8 | LIQUID DEVELOPER H | 5.0 | 2.0 | 11.0 | 82.0 | 0.0 | 0.032 | Δ |
| EXAMPLE 9 | LIQUID DEVELOPER I | 4.0 | 1.6 | 0.5 | 91.1 | 2.8 | 0.037 | Δ |
| EXAMPLE 10 | LIQUID DEVELOPER J | 5.0 | 2.0 | 10.5 | 23.0 | 59.5 | 0.032 | Δ |
| COMPARATIVE EXAMPLE 1 | LIQUID DEVELOPER K | 5.0 | 2.0 | 0.0 | 18.0 | 75.0 | 0.140 | x |
| COMPARATIVE EXAMPLE 2 | LIQUID DEVELOPER M | 5.0 | 2.1 | 0.0 | 92.9 | 0.0 | 0.165 | x |

(Formation of Image)

Using the wet-type image forming apparatus (color printer) 1A (an experimental apparatus of the wet-type image forming apparatus manufactured by Kyocera Mita Corporation, linear velocity: 116 mm/s) shown in FIG. 1 that does not include the fixing part, the cyan liquid developers A to M were placed inside the cyan image forming unit FC, a square solid image (5 cm×5 cm) filled uniformly with a pigment application amount correspond to 0.026 mg/cm$^2$ was formed on printing paper (wet development paper "EP-L" manufactured by Mitsubishi Paper Mills Limited: 128 g/m$^2$) as the sheet. Here, the thickness of the liquid developer layer on the circumferential surface of the developing roller 141 was set to 5 μm. Moreover, the development field to be applied to the developing roller 141 upon forming the image on the surface of the photoconductor drum 10 based on the image data was set to 400 V. Subsequently, the sheet ejected from the ejection part 6 was subject to fixability evaluation. The other image forming conditions are shown below.

Bias potential of the developing corona charge with the developing roller charging device 147: 4000 V Intermediate transfer belt 21: Made of polyimide Dark potential of the photoconductor drum 10: +550 V Light potential of the photoconductor drum 10: +10 V Primary transfer voltage of the primary transfer roller 20: 300 V (constant voltage control)

Secondary transfer current of the secondary transfer part 4: 40 μA (constant current control)

(Scratch Test (Determination of Fixability))

The square solid image of 5 cm×5 cm was printed using the liquid developers A to M, as described above. A metal columnar weight (diameter of 50 mm with cloth (padding) placed at the bottom face thereof) with a mass of 300 g was placed on the image portion, and the weight was moved laterally across the image so that it goes outside the image, and the same movement across the same path was repeated 10 times. In order to observe whether the image was rubbed and scratched with the mass of the weight, the image density of the portion outside the solid image and which is the portion where the weight moved was measured as circumferential image density with a spectrophotometer ("X-rite Spectro Eye" manufactured by Gretag Macbeth). The evaluation standard of the fixability was as follows; namely, "O" was indicated for those with a circumferential image density of less than 0.02, "Δ" was indicated for those with a circumferential image density of 0.02 or more and less than 0.06, and "×" was indicated for those with a circumferential image density of 0.06 or more. The results are shown in Table 8.

(Results and Consideration)

As evident from Table 8, the liquid developers A to J (Examples 1 to 10) containing an organic macromolecular compound soluble in a carrier fluid showed fixability to paper (sheet) even upon using the pigments themselves as the colored particles in a liquid developer in which the pigments are dispersed in the carrier fluid. Moreover, the liquid developers A to F (Examples 1 to 6) in which the content of the organic macromolecular compound in the liquid developer is within the range of 1 to 10 mass percent yielded even more favorable fixability.

Meanwhile, image could not be fixed properly with the liquid developer K (Comparative Example 1) that does not contain an organic macromolecular compound soluble in a carrier fluid, and the liquid developer M (Comparative Example 2) containing pigments coated with a binding resin (toners).

As described above, as a result of using a liquid developer in which an organic macromolecular compound capable of fixing colored particles is dissolved in a carrier fluid, favorable fixability is yielded and a high quality image can be obtained even upon dispersing the pigments themselves in the carrier fluid.

As explained above in detail with specific examples, since the liquid developer according to this embodiment contains an electrically insulating carrier fluid, colored particles dispersed in the carrier fluid, and an organic macromolecular compound capable of fixing the colored particles to a recording medium, and since the organic macromolecular compound is dissolved in the carrier fluid and the colored particles are pigments, the organic macromolecular compound coats the pigments remaining on the surface of the recording medium and forms a coated layer by remaining on the surface of the recording medium, and the pigments are fixed to the recording medium with the coated layer of the organic macromolecular compound. It is thereby possible to fix the pigments; that is, the image, to the recording medium with non-heating or at low temperature without consuming considerable thermal energy or light energy, or by significantly reducing the consumption thereof, and reduce the consumption energy in the wet-type image forming apparatus. Moreover, it is possible to eliminate or simplify the conventional fixing part (fixing device) itself which consumes considerable thermal or light energy, and thereby achieve the simplification and cost reduction of the wet-type image forming apparatus.

Furthermore, upon transferring the liquid developer to the paper, at the image portion, the carrier fluid permeates the paper, the organic macromolecular compound is deposited on the surface of the paper, and the colored particles are fixed to the paper. At the non-image portion, the organic macromolecular compound is deposited on the surface of the paper as a result of the carrier fluid permeating the paper. Thus, since the deposited organic macromolecular compound is fixed to the paper at the image portion and the non-image portion, the colored particles may not fall off from the paper and smear the image. It is thereby possible to obtain a high quality image.

When the organic macromolecular compound is at least one selected from a group consisting of styrene elastomer, polyvinyl butyral, cyclic olefin copolymer and cellulose ether, a liquid developer with superior fixability can be obtained reliably without consuming thermal energy or light energy.

When the content of the organic macromolecular compound in the liquid developer is 1 to 10 mass percent, the favorable drying property of the coated layer and the scratch resistance of the image can be ensured while maintaining superior fixability without consuming considerable thermal energy or light energy.

A wet-type image forming apparatus comprising a charging device for charging a surface of a photoconductor drum, an exposure device for forming an electrostatic latent image on the surface of the charged photoconductor drum, a liquid developing device for developing an electrostatic latent image on the surface of the photoconductor drum with a liquid developer, and a transfer device for transferring the developed image to a recording medium, and in which the wet-type image forming apparatus uses the foregoing liquid developer as the liquid developer is a favorable wet-type image forming apparatus from the perspective of energy conservation since the apparatus does not consume considerable thermal or light energy upon performing the fixing process of fixing the transferred image to the recording medium.

This application is based on Japanese Patent application serial Nos. 2010-058012, 2010-069526, 2010-096595, 2010-098896 and 2010-122304 filed in Japan Patent Office on Mar. 15, 2010, Mar. 25, 2010, Apr. 20, 2010, Apr. 22, 2010 and May 28, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A liquid developer containing an electrically insulating carrier fluid, colored particles dispersed in the carrier fluid, and an organic macromolecular compound for fixing the colored particles to a recording medium, wherein:

the colored particles consist of pigments and are not toners in which pigments are dispersed in a binding resin, the organic macromolecular compound is dissolved in the carrier fluid and is at least one selected from a group consisting of styrene elastomer, polyvinyl butyral, cyclic olefin copolymer and cellulose ether, and the content of the styrene elastomer in the liquid developer is 0.1 to 10 mass percent when the styrene elastomer is contained in the developer.

2. The liquid developer according to claim 1, wherein the styrene elastomer is a block copolymer having a structure represented by Formula 1 when a polymer block made of an aromatic vinyl compound is A and a polymer block made of an olefin compound or a conjugated diene compound is B:

$$[A\text{-}B]_x\text{-}A \qquad \text{(Formula 1)}$$

(In the formula, x represents an integer in which a number average molecular weight is 1,000 to 100,000.)

3. The liquid developer according to claim 2, wherein the styrene elastomer is styrene-butadiene elastomer in which the polymer block A and the polymer block B have a structure represented by Formula 2:

(Formula 2)

POLYMER BLOCK A POLYMER BLOCK B

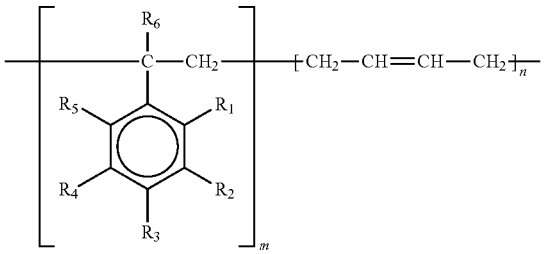

(In the formula, $R_1$, $R_2$, $R_4$, $R_5$, $R_6$ represent hydrogen atoms or a methyl group; $R_3$ represents hydrogen atoms, a saturated alkyl group with a carbon number of 1 to 20, a methoxy group, an ethoxy group, a phenyl group or halogen atoms; and m and n represent such an integer that the content of the polymer block A in the styrene-butadiene elastomer is 5 to 75 mass percent.)

4. The liquid developer according to claim 1, wherein, when polyvinyl butyral is contained, the carrier fluid is at least one selected from a group consisting of triethyleneglycol bis(2-ethylhexanate), castor oil and epoxidized soybean oil.

5. The liquid developer according to claim 1, wherein the content of the polyvinyl butyral in the liquid developer is 1 to 10 mass percent.

6. The liquid developer according to claim 1, wherein the cyclic olefin copolymer is a copolymer of norbornene and ethylene.

7. The liquid developer according to claim 1, wherein the content of the cyclic olefin copolymer in the liquid developer is 2 to 8 mass percent.

8. The liquid developer according to claim 1, wherein the cellulose ether is ethyl cellulose.

9. The liquid developer according to claim 1, wherein the content of the cellulose ether in the liquid developer is 1 to 6 mass percent.

10. The liquid developer according to claim 1, containing, when cellulose ether is contained, tall oil fatty acid as the carrier fluid.

11. The liquid developer according to claim 10, wherein the content of the tall oil fatty acid in the total carrier fluid is 20 to 90 mass percent.

* * * * *